US011732599B2

(12) United States Patent
Kim et al.

(10) Patent No.: US 11,732,599 B2
(45) **Date of Patent: *Aug. 22, 2023**

(54) METHODS AND APPARATUS FOR REAL-TIME CLEARANCE ASSESSMENT USING A PRESSURE MEASUREMENT

(71) Applicant: General Electric Company, Schenectady, NY (US)

(72) Inventors: Taehong Kim, West Chester, OH (US); Aaron J. Sentis, Lynn, MA (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/952,905

(22) Filed: Sep. 26, 2022

(65) Prior Publication Data

US 2023/0028412 A1 Jan. 26, 2023

Related U.S. Application Data

(63) Continuation of application No. 17/142,047, filed on Jan. 5, 2021, now Pat. No. 11,454,131.

(51) Int. Cl.
*F01D 11/20* (2006.01)

(52) U.S. Cl.
CPC ..... *F01D 11/20* (2013.01); *F05D 2220/32* (2013.01); *F05D 2240/55* (2013.01); *F05D 2270/44* (2013.01)

(58) Field of Classification Search
CPC .. F01D 11/20; F05D 2220/32; F05D 2240/55; F05D 2270/44
See application file for complete search history.

(56) References Cited

U.S. PATENT DOCUMENTS 4,813,273 A * 3/1989 Parsons ..... G01B 7/14 73/660
5,012,420 A 4/1991 Walker et al.
5,140,494 A * 8/1992 Slade ..... F01D 21/04 361/231

(Continued)

OTHER PUBLICATIONS

United States Patent and Trademark Office, "Non-Final Office Action," issued in connection with U.S. Appl. No. 17/142,047, dated Feb. 16, 2022, 12 pages.

(Continued)

*Primary Examiner* — Igor Kershteyn
*Assistant Examiner* — Theodore C Ribadeneyra
(74) *Attorney, Agent, or Firm* — Hanley, Flight & Zimmerman, LLC

(57) ABSTRACT

Methods and apparatus for real-time clearance assessment using a pressure measurement are disclosed. An example method includes determining a first and a second static pressure measurement at a first measurement location and a second measurement location, respectively, relative to the blade tip clearance, determining a normalized pressure measurement using the first and second static pressure measurements, generating a conversion curve to correlate the normalized pressure measurement with a clearance measurement, wherein the conversion curve is developed for the turbine engine during testing at a plurality of operating conditions, and adjusting active clearance control of the blade tip clearance based on the conversion curve.

20 Claims, 10 Drawing Sheets

(56) References Cited

U.S. PATENT DOCUMENTS

| | | | | |
|---|---|---|---|---|
| 6,041,659 | A | 3/2000 | Wilda et al. | |
| 6,715,984 | B2 * | 4/2004 | Nakajima | F04D 27/001 415/118 |
| 6,717,418 | B2 | 4/2004 | Orenstein | |
| 7,465,145 | B2 | 12/2008 | Kane | |
| 7,916,311 | B2 * | 3/2011 | Corn | G01B 11/14 356/625 |
| 8,105,015 | B2 | 1/2012 | Moore et al. | |
| 8,126,628 | B2 | 2/2012 | Hershey et al. | |
| 8,322,973 | B2 | 12/2012 | Shang et al. | |
| 8,451,459 | B2 * | 5/2013 | Hynous | G01B 11/14 356/625 |
| 8,505,364 | B2 | 8/2013 | Batzinger et al. | |
| 9,329,197 | B2 | 5/2016 | Sato | |
| 9,810,092 | B2 | 11/2017 | Roberts et al. | |
| 10,731,505 | B2 * | 8/2020 | Ren | G01B 21/16 |
| 11,454,131 | B2 | 9/2022 | Kim et al. | |
| 2005/0286995 | A1 | 12/2005 | Shang et al. | |
| 2006/0291059 | A1 * | 12/2006 | Heyworth | G01B 11/14 359/570 |
| 2007/0005219 | A1 * | 1/2007 | Muramatsu | F01D 21/003 701/100 |
| 2012/0069355 | A1 * | 3/2012 | Hynous | G01B 11/026 356/625 |
| 2014/0064924 | A1 * | 3/2014 | Warren | G01M 13/00 415/118 |
| 2015/0075265 | A1 | 3/2015 | Memmer et al. | |
| 2015/0268074 | A1 | 9/2015 | Sato | |
| 2015/0323301 | A1 * | 11/2015 | Zhe | F01D 11/14 324/207.15 |

OTHER PUBLICATIONS

United States Patent and Trademark Office, "Notice of Allowance and Fee(s) Due," issued in connection with U.S. Appl. No. 17/142,047, dated May 20, 2022, 6 pages.

* cited by examiner

METHODS AND APPARATUS FOR REAL-TIME CLEARANCE ASSESSMENT USING A PRESSURE MEASUREMENT

RELATED APPLICATIONS

This patent arises from a continuation of U.S. patent application Ser. No. 17/142,047, now U.S. patent Ser. No. 11/454,131, filed on Jan. 5, 2021. U.S. patent application Ser. No. 17/142,047 is hereby incorporated herein by reference in its entirety.

FIELD OF THE DISCLOSURE

This disclosure relates generally to turbine engines and, more particularly, to methods and apparatus for real-time clearance assessment using a pressure measurement.

BACKGROUND

Turbine engines are some of the most widely-used power generating technologies. Gas turbines are an example of an internal combustion engine that uses a burning air-fuel mixture to produce hot gases that spin the turbine, thereby generating power. Application of gas turbines can be found in aircraft, trains, ships, electrical generators, gas compressors, and pumps. For example, modern aircraft rely on a variety of gas turbine engines as part of a propulsion system to generate thrust, including a turbojet, a turbofan, a turboprop, and an afterburning turbojet. Such engines include a combustion section, a compressor section, a turbine section, and an inlet, providing high power output with a high thermal efficiency.

Engine efficiency, stability, and operational temperature can be significantly affected by blade tip clearance. For example, turbine tip clearance represents a radial distance between the turbine blade tip and the turbine containment structure. Increase in tip clearance contributes to a decrease in turbine efficiency, given that the power that a turbine provides (or a compressor consumes) depends on airflow occurring through the area of the blade location. As such, presence of the tip clearance results in altered airflow, compromising the intended flow path and affecting turbine efficiency, including a potential increase in fuel consumption. Contributing factors to changes in tip clearance are temperature and rotating speed, among others. Active clearance control can be achieved using Full Authority Digital Engine Control (FADEC)-based optimization of tip clearances. However, such optimization does not account for blade tip loss progression, resulting in adjustments that are based on clearance measurements associated with new blade tip parameters. Accordingly, real-time measurement of blade tip clearance that accounts for blade tip loss would be welcomed in the technology.

BRIEF SUMMARY

Methods and apparatus for real-time clearance assessment using a pressure measurement are disclosed.

Certain examples include a method to assess real-time blade tip clearance in a turbine engine, the method including determining a first and a second static pressure measurement at a first measurement location and a second measurement location, respectively, relative to the blade tip clearance and determining a normalized pressure measurement using the first and second static pressure measurements. The method also includes generating a conversion curve to correlate the normalized pressure measurement with a clearance measurement and adjusting active clearance control of the blade tip clearance based on a comparison of real-time in-flight pressure measurements to the conversion curve.

Certain examples provide an apparatus to assess real-time blade tip clearance in a turbine engine, the apparatus including a pressure sensor to determine a first and a second static pressure measurement, respectively, at a first measurement location and a second measurement location relative to the blade tip clearance and a conversion curve generator to determine a normalized pressure measurement using the first and second static pressure measurements and generate a conversion curve to correlate the normalized pressure measurement with a clearance measurement. The apparatus also includes an active clearance controller to adjust active clearance control of the blade tip clearance based on a comparison of real-time in-flight pressure measurements to the conversion curve.

Certain examples provide a non-transitory computer readable medium including machine-readable instructions that, when executed, cause a processor to at least determine a first and a second static pressure measurement at a first measurement location and a second measurement location, respectively, relative to the blade tip clearance based on input signals received as input to the processor, determine a normalized pressure measurement using the first and second static pressure measurements. The instructions further cause the processor to generate a conversion curve to correlate the normalized pressure measurement with a clearance measurement and adjust active clearance control of the blade tip clearance based on a comparison of real-time in-flight pressure measurements to the conversion curve.

Figure 1:
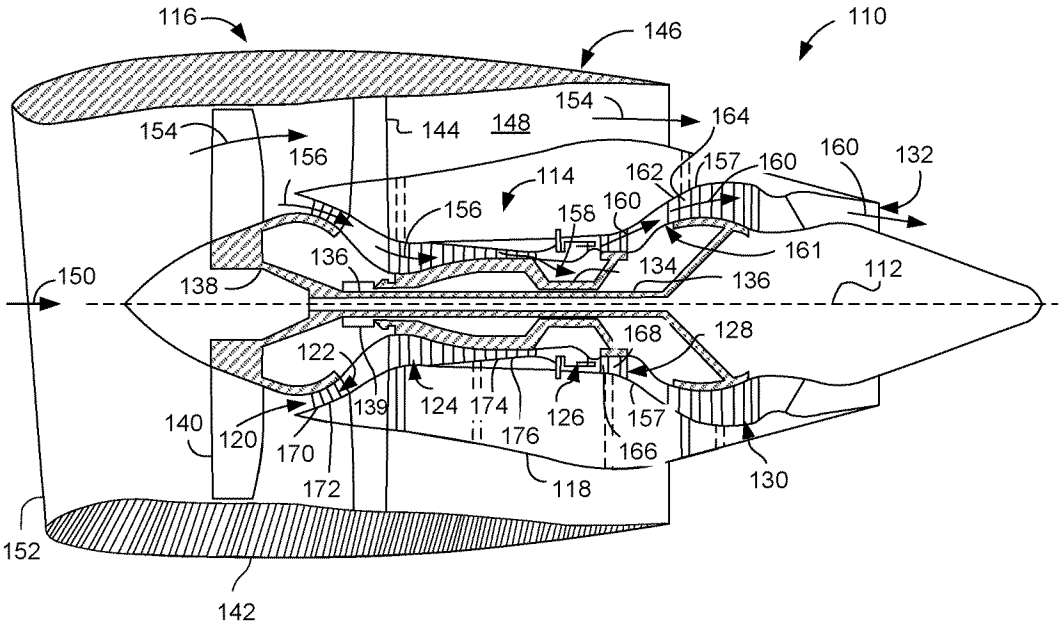
FIG. 1 is a schematic cross-sectional view of an example high-bypass turbofan-type gas turbine engine.

The figures are not to scale. Instead, the thickness of the layers or regions may be enlarged in the drawings. In general, the same reference numbers will be used throughout the drawing(s) and accompanying written description to refer to the same or like parts. As used in this patent, stating that any part (e.g., a layer, film, area, region, or plate) is in any way on (e.g., positioned on, located on, disposed on, or formed on, etc.) another part, indicates that the referenced part is either in contact with the other part, or that the referenced part is above the other part with one or more intermediate part(s) located therebetween. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Stating that any part is in "contact" with another part means that there is no intermediate part between the two parts. Although the figures show layers and regions with clean lines and boundaries, some or all of these lines and/or boundaries may be idealized. In reality, the boundaries and/or lines may be unobservable, blended, and/or irregular.

DETAILED DESCRIPTION

During operation, a turbine engine is exposed to high temperatures, high pressures, and high speeds. Engine performance can be improved using active clearance control (ACC), which manages the clearance between a gas turbine containment structure (e.g., casing) and the tips of the rotating blades (e.g., turbine tip clearance). For example, a turbine clearance control system uses control valves to manage thermal expansion of the turbine case that surround the engine stages, thereby controlling tip clearance. Tip clearance is maintained at a minimum value to ensure maximum propulsive efficiency. For example, combusted gas temperatures can exceed 1,000 degrees Celsius, causing turbine blade expansion as well as expansion of the containment structure, increasing tip clearance and reducing overall turbine efficiency (e.g., increased fuel burn and fuel consumption). Control of thermal expansion and contraction of the containment structure permits turbine tip clearance control. For example, the containment structure can be cooled and contracted using circulating air. The engine's Full Authority Digital Engine Control (FADEC) engine parameters (e.g., air temperature by using sensors or calculation) during the entire flight cycle and engages ACC via incremental opening or closing of the control valves, permitting control of the containment structure's thermal expansion to achieve optimal or otherwise improved blade tip clearance.

While FADEC calculates tip clearances in operating conditions to control ACC and optimize/improve tip clearance, FADEC does not compensate for blade tip loss progression (e.g., associated with rub, oxidation, etc.). As such, FADEC-associated blade tip clearance optimizations are based on calculations determined using blade tip parameters associated with a newly-installed blade rather than real-time blade tip parameters that account for blade tip loss. Over time, actual tip clearance and corresponding engine efficiency calculations may not be representative of the real-time parameters because the calculations are occurring based on initial, stock, or "ideal" measurements of design intent. Methods and apparatus disclosed herein for real-time clearance assessment using a pressure measurement allow for accurate tip clearance control once blade tip loss has occurred.

In the following detailed description, reference is made to the accompanying drawings that form a part hereof, and in which is shown by way of illustration specific examples that may be practiced. These examples are described in sufficient detail to enable one skilled in the art to practice the subject matter, and it is to be understood that other examples may be utilized. The following detailed description is therefore, provided to describe an exemplary implementation and not to be taken limiting on the scope of the subject matter described in this disclosure. Certain features from different aspects of the following description may be combined to form yet new aspects of the subject matter discussed below.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, and (7) A with B and with C. As used herein in the context of describing structures, components, items, objects and/or things, the phrase "at least one of A and B" is intended to refer to implementations including any of (1) at least one A, (2) at least one B, and (3) at least one A and at least one B. Similarly, as used herein in the context of describing structures, components, items, objects and/or things, the phrase "at least one of A or B" is intended to refer to implementations including any of (1) at least one A, (2) at least one B, and (3) at least one A and at least one B. As used herein in the context of describing the performance or execution of processes, instructions, actions, activities and/or steps, the phrase "at least one of A and B is intended to refer to implementations including any of (1) at least one A, (2) at least one B, and (3) at least one A and at least one B. Similarly, as used herein in the context of describing the performance or execution of processes, instructions, actions, activities and/or steps, the phrase" at least one of A or B is intended to refer to implementations including any of (1) at least one A, (2) at least one B, and (3) at least one A and at least one B.

As used herein, singular references (e.g., "a", "an", "first", "second", etc.) do not exclude a plurality. The term "a" or "an" entity, as used herein, refers to one or more of that entity. The terms "a" (or "an"), "one or more", and "at least one" can be used interchangeably herein. Furthermore, although individually listed, a plurality of means, elements or method actions may be implemented by, e.g., a single unit or processor. Additionally, although individual features may be included in different examples or claims, these may possibly be combined, and the inclusion in different examples or claims does not imply that a combination of features is not feasible and/or advantageous.

As used herein, the terms "system," "unit," "module,", "engine,", "component," etc., may include a hardware and/or software system that operates to perform one or more functions. For example, a module, unit, or system may include a computer processor, controller, and/or other logic-based device that performs operations based on instructions stored on a tangible and non-transitory computer readable storage medium, such as a computer memory. Alternatively, a module, unit, or system may include a hard-wires device that performs operations based on hard-wired logic of the device. Various modules, units, engines, and/or systems shown in the attached figures may represent the hardware that operates based on software or hardwired instructions, the software that directs hardware to perform the operations, or a combination thereof.

A turbine engine, also called a combustion turbine or a gas turbine, is a type of internal combustion engine. Turbine engines are commonly utilized in aircraft and power-generation applications. As used herein, the terms "asset," "aircraft turbine engine," "gas turbine," "land-based turbine engine," and "turbine engine" are used interchangeably. A basic operation of the turbine engine includes an intake of fresh atmospheric air flow through the front of the turbine engine with a fan. In some examples, the air flow travels through an intermediate-pressure compressor or a booster compressor located between the fan and a high-pressure compressor. The booster compressor is used to supercharge or boost the pressure of the air flow prior to the air flow entering the high-pressure compressor. The air flow can then travel through the high-pressure compressor that further pressurizes the air flow. The high-pressure compressor includes a group of blades attached to a shaft. The blades spin at high speed and subsequently compress the air flow. The high-pressure compressor then feeds the pressurized air flow to a combustion chamber. In some examples, the high-pressure compressor feeds the pressurized air flow at speeds of hundreds of miles per hour. In some instances, the combustion chamber includes one or more rings of fuel injectors that inject a steady stream of fuel into the combustion chamber, where the fuel mixes with the pressurized air flow.

In the combustion chamber of the turbine engine, the fuel is ignited with an electric spark provided by an igniter, where the fuel in some examples burns at temperatures of more than 1,000 degrees Celsius. The resulting combustion produces a high-temperature, high-pressure gas stream (e.g., hot combustion gas) that passes through another group of blades of a turbine. The turbine includes an intricate array of alternating rotating and stationary airfoil-section blades. As the hot combustion gas passes through the turbine, the hot combustion gas expands, causing the rotating blades to spin. The rotating blades serve at least two purposes. A first purpose of the rotating blades is to drive the booster compressor and/or the high-pressure compressor to draw more pressured air into the combustion chamber. For example, the turbine is attached to the same shaft as the high-pressure compressor in a direct-drive configuration, thus, the spinning of the turbine causes the high-pressure compressor to spin. A second purpose of the rotating blades is to spin a generator operatively coupled to the turbine section to produce electricity, and/or to drive a rotor, fan or propeller. For example, the turbine can generate electricity to be used by an aircraft, a power station, etc. In the example of an aircraft turbine engine, after passing through the turbine, the hot combustion gas exits the aircraft turbine engine through a nozzle at the back of the aircraft turbine engine.

Referring now to the drawings, wherein identical numerals indicate the same elements throughout the figures, FIG. 1 is a schematic cross-sectional view of an example high-bypass turbofan-type gas turbine engine 110 ("turbofan 110"). As shown in FIG. 1, the turbofan 110 defines a longitudinal or axial centerline axis 112 extending therethrough for reference. In general, the turbofan 110 includes a core turbine or gas turbine engine 114 disposed downstream from a fan section 116.

The core turbine engine 114 generally includes a substantially tubular outer casing 118 that defines an annular inlet 120. The outer casing 118 can be formed from a single casing or multiple casings. The outer casing 118 encloses, in serial flow relationship, a compressor section having a booster or low pressure compressor 122 ("LP compressor 122") and a high pressure compressor 124 ("HP compressor 124"), a combustion section 126, a turbine section having a high pressure turbine 128 ("HP turbine 128") and a low pressure turbine 130 ("LP turbine 130"), and an exhaust section 132. A high pressure shaft or spool 134 ("HP shaft 134") drivingly couples the HP turbine 128 and the HP compressor 124. A low pressure shaft or spool 136 ("LP shaft 136") drivingly couples the LP turbine 130 and the LP compressor 122. The LP shaft 136 can also couple to a fan spool or shaft 138 of the fan section 116. In some examples, the LP shaft 136 is coupled directly to the fan shaft 138 (e.g., a direct-drive configuration). In alternative configurations, the LP shaft 136 can couple to the fan shaft 138 via a reduction gear 139 (e.g., an indirect-drive or geared-drive configuration).

As shown in FIG. 1, the fan section 116 includes a plurality of fan blades 140 coupled to and extending radially outwardly from the fan shaft 138. An annular fan casing or nacelle 142 circumferentially encloses the fan section 116 and/or at least a portion of the core turbine 114. The nacelle 142 can be supported relative to the core turbine 114 by a plurality of circumferentially-spaced apart outlet guide vanes 144. Furthermore, a downstream section 146 of the nacelle 142 can enclose an outer portion of the core turbine 114 to define a bypass airflow passage 148 therebetween.

As illustrated in FIG. 1, air 150 enters an inlet portion 152 of the turbofan 110 during operation thereof. A first portion 154 of the air 150 flows into the bypass flow passage 148, while a second portion 156 of the air 150 flows into the inlet 120 of the LP compressor 122. One or more sequential stages of LP compressor stator vanes 170 and LP compressor rotor blades 172 coupled to the LP shaft 136 progressively compress the second portion 156 of the air 150 flowing through the LP compressor 122 en route to the HP compressor 124. Next, one or more sequential stages of HP compressor stator vanes 174 and HP compressor rotor blades 176 coupled to the HP shaft 134 further compress the second portion 156 of the air 150 flowing through the HP compressor 124. This provides compressed air 158 to the combustion section 126 where it mixes with fuel and burns to provide combustion gases 160.

The combustion gases 160 flow through the HP turbine 128 where one or more sequential stages of HP turbine stator vanes 166 and HP turbine rotor blades 168 coupled to the HP shaft 134 extract a first portion of kinetic and/or thermal energy therefrom. This energy extraction supports operation of the HP compressor 124. The combustion gases 160 then flow through the LP turbine 130 where one or more sequential stages of LP turbine stator vanes 162 and LP turbine rotor blades 164 coupled to the LP shaft 136 extract a second portion of thermal and/or kinetic energy therefrom. This energy extraction causes the LP shaft 136 to rotate, thereby supporting operation of the LP compressor 122 and/or rotation of the fan shaft 138. The combustion gases 160 then exit the core turbine 114 through the exhaust section 132 thereof. In the example of FIG. 1, an example turbine casing 157 surrounds the LP turbine rotor blades 164 and/or the HP turbine rotor blades 168. A turbine frame with a fairing assembly 161 is located between the HP turbine 128 and the LP turbine 130. The turbine frame 161 acts as a supporting structure, connecting a high-pressure shaft's rear bearing with the turbine housing and forming an aerodynamic transition duct between the HP turbine 128 and the LP turbine 130. Fairings form a flow path between the high-pressure and low-pressure turbines and can be formed using metallic castings (e.g., nickel-based cast metallic alloys, etc.).

Along with the turbofan 110, the core turbine 114 serves a similar purpose and is exposed to a similar environment in land-based gas turbines, turbojet engines in which the ratio of the first portion 154 of the air 150 to the second portion 156 of the air 150 is less than that of a turbofan, and unducted fan engines in which the fan section 116 is devoid of the nacelle 142. In each of the turbofan, turbojet, and unducted engines, a speed reduction device (e.g., the reduction gearbox 139) can be included between any shafts and spools. For example, the reduction gearbox 139 is disposed between the LP shaft 136 and the fan shaft 138 of the fan section 116.

Figure 2A:
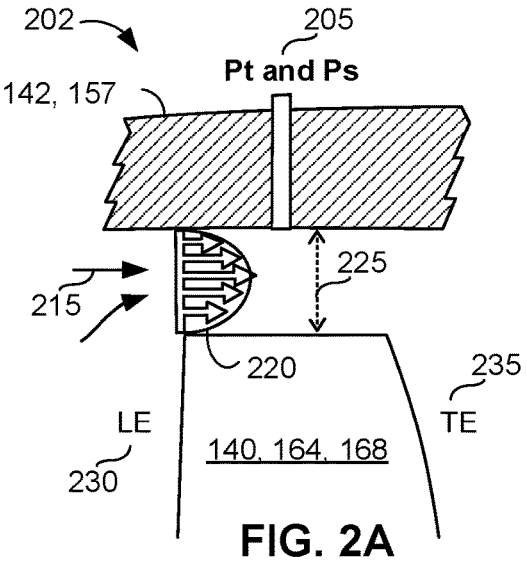
FIG. 2A illustrates an example one-point pressure measurement at a first location showing airflow when radial tip clearance is increased.
Figure 2B:
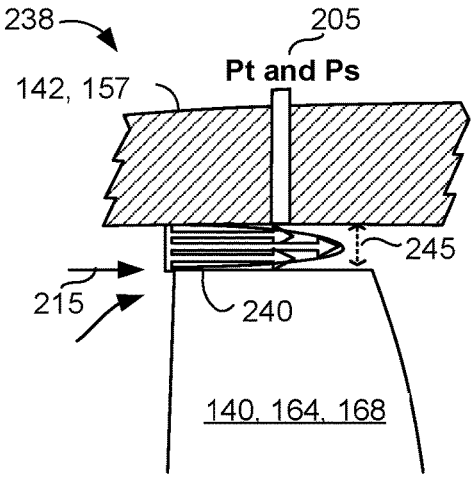
FIG. 2B illustrates an example one-point pressure measurement at the first location showing airflow when radial tip clearance is decreased.

FIG. 2A illustrates an example one-point pressure measurement 202 at an example first location 205 showing an example airflow path 215 when an example radial tip clearance 225 is increased. FIG. 2B illustrates an example one-point pressure measurement 238 at the first location 205 showing an example airflow path 240 when an example radial tip clearance 245 is decreased. A radial distance of a tip of the fan blade 140 and/or the rotor blade 164, 168 (e.g., LP turbine rotor blade 164, HP turbine rotor blade 168) from the casing 142, 157 (e.g., fan casing, turbine casing, etc.) defines the blade tip clearance(s) 225, 245. The example of FIG. 2A shows an increase in the radial tip clearance 225 while the example of FIG. 2B shows a decrease in the radial tip clearance 245 as a result of active clearance control (ACC) (e.g., using an example active clearance controller 705, as described in connection with FIG. 7). For example, the ACC maintains a tight clearance for engine performance, but attempts to avoid a risk of rubbing between the tip of the rotor blade 164, 168 and the turbine casing 157. For example, the ACC system includes a butterfly valve with angular changes that alter the amount of cooling airflow to achieve the desired tip clearance to maintain engine efficiency. In some examples, the fan blade 140 and/or the rotor blade 164, 168 growth occurs relative to casing(s) 142, 157 (e.g., during aircraft take-off, etc.), resulting from an increase in shaft speed. By controlling the clearances 225, 245, ACC contributes to the overall engine 110 efficiency by lowering operating temperatures, such that the engine 110 operates with less fuel burn. Decreases in operating temperatures reduce engine deterioration and increase time-on-wing while also lowering maintenance costs.

The turbine casing 157 can include a containment structure (e.g., a shroud made of a superalloy-based material, etc.). In some examples, the exterior of the casing 157 containment structure (e.g., a shroud) can be cooled using by-pass flow from the high-pressure compressor 124 of FIG. 1. In the example of FIG. 2A and FIG. 2B, the airflow path 215 represents the flow of combusted gas (e.g., represented using example flow profile(s) 220, 240) that causes rotor blade 164, 168 expansion as well as expansion of the casing 157. In the example of FIG. 2A, the combusted gas flow path 215 originates from an example leading edge 230 and flows in the direction of an example trailing edge 235. In the example of FIG. 2A, ACC-based airflow causes the containment structure (e.g., holding shrouds) to expand, while in the example of FIG. 2B, ACC-based airflow causes the structure to contract. As such, radial tip clearance(s) 225, 245 between the blade 164, 168 and the containment structure 157 can be regulated using the ACC-based airflow. For example, ACC can allow minimal clearance to maintain thrust generation, such as during aircraft take-off. The clearance settings are important to help ensure that rubbing does not occur. For example, flight conditions causing heating of the blade 164, 168 that produces a clearance closure would otherwise result in rubbing of the rotor blade(s) 164, 168 against structure 157. Likewise, in some examples a decrease of the radial tip clearance 245 of FIG. 2B can be due to the contraction (e.g., shrinkage) of the casing 157. For example, the ACC system regulates closing of the clearance when an aircraft is in a cruise mode, since the greatest reduction in specific fuel consumption (SFC) can be achieved during the longest portion of the entire flight profile.

Figure 2C:
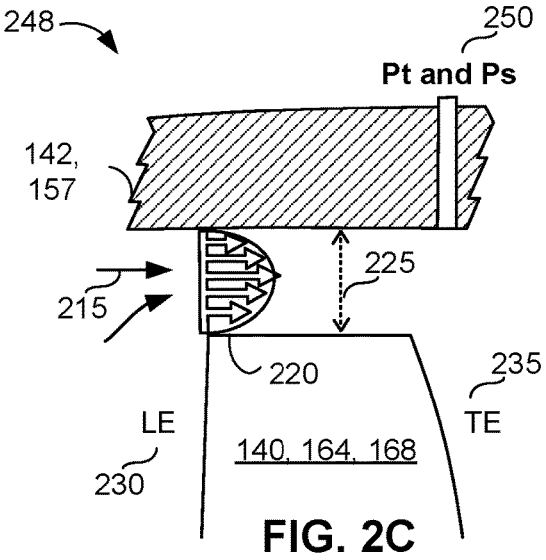
FIG. 2C illustrates an example one-point pressure measurement at a second location showing airflow when radial tip clearance is increased.
Figure 2D:
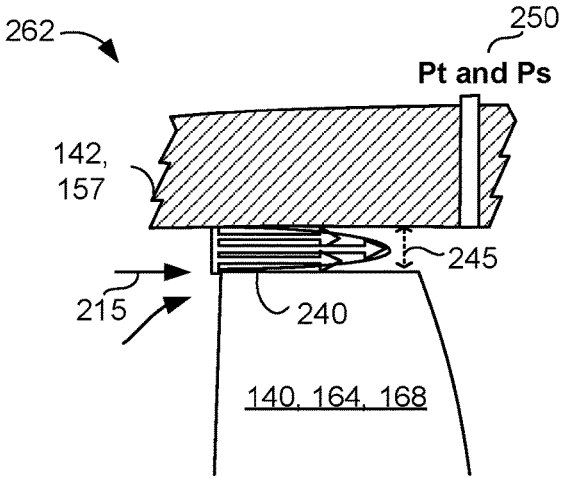
FIG. 2D illustrates an example one-point pressure measurement at the second location showing airflow when radial tip clearance is decreased.

To facilitate real-time assessment of blade tip clearance, pressure measurement(s) can be obtained in at least one location (e.g., mid, front, aft, etc.) relative to the blade tip clearance 225. In the examples of FIGS. 2A-2B, a sample measurement at the first location 205 is obtained such that the location is at the mid-portion of the tip clearance(s) 225, 245. In the examples of FIGS. 2C-2D, a sample measurement at a second location 250 is obtained such that the location is at the aft of the tip clearance(s) 225, 245. In some examples, pressure measurements at multiple locations (e.g., a two-point pressure measurement, a three-point pressure measurement, etc.) can be made, as described in connection with FIGS. 3A-3D and FIGS. 4A-4B. For example, measurements at front, mid, and/or aft locations relative to the tip clearance permits identification of clearance changes based on pressure variation. As described in connection with FIGS. 2E-2F, conversion curves can be determined using new engine tests on different power levels (e.g., high, low, etc.), with any blade tip loss (e.g., fan blade 140, LP turbine rotor blade 164, HP turbine rotor blade 168, etc.) assessed by offset from the determined curves. As such, real-time signal measurement and use of the conversion method described herein permits immediate adjustment of ACC modulation and maintenance of tight clearances, even once the engine has started to degenerate (e.g., experience blade tip loss as a result of oxidation, rubbing, thermal fatigue, etc.).

In the examples of FIGS. 2A and 2B, a static pressure measurement ($P_S$) and a total pressure measurement ($P_T$) are obtained at any one location (e.g., mid-point as shown in the example of FIGS. 2A and 2B and/or aft as shown in the example of FIGS. 2C and 2D, etc.). For example, the one-point location (e.g., mid-point 205, aft point 250, etc.) can be used to measure a total (e.g., reference) pressure and a static pressure at once. For example, total pressure ($P_T$) can be defined as the sum of static pressure ($P_S$) and dynamic pressure ($P_D$), where dynamic pressure can be defined as $\frac{1}{2} * \rho * V^2$, such that ρ represents gas density (e.g., $kg/m^3$) and V represents gas velocity (e.g., m/s). In some examples, the gas velocity V affects the tip clearance reading (e.g., due to changes in radial gap(s) 225, 245). Tip clearance changes can occur directly as a result of ACC system-based modulation and/or as a result of rotor blade 164, 168 deterioration (e.g., blade tip reduction). In the example of FIG. 2A and FIG. 2B, V changes based on the airflow profile(s) 220, 240 resulting from the clearance gap(s) 225, 245 which are either opened (FIG. 2A) or closed (FIG. 2B). As such, total pressure measurements ($P_T$) and static pressure measurements ($P_S$) are obtained at a first location (e.g., reference point) 205 (e.g., a mid-point location). While FIGS. 2A and 2B show a one reference point-based pressure measurement at the first location 205, FIGS. 2C-2D represent a one reference point-based pressure measurement at a second location 250, positioned downstream of the first location 205, with ACC-modulated clearance(s) 225, 245 opened and closed, respectively. As such, the location of the one reference point-based pressure measurement can vary and is not confined to a specific region of the clearance(s) 225, 245 of FIGS. 2A-2D. Conversion curves of FIGS. 2E-2F can thereby be generated using either the first location 205 or the second location 250 when determining a relationship between pressure efficiency (Pη) and blade tip clearance.

Figure 2E:
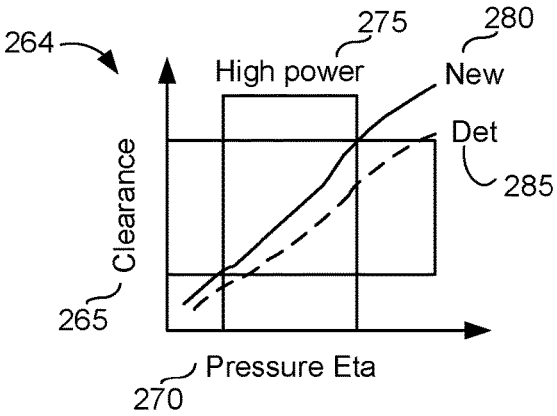
FIG. 2E illustrates an example conversion curve determined using clearance and pressure efficiency based on the one-point pressure measurement of FIGS. 2A-2D during high power operation.
Figure 2F:
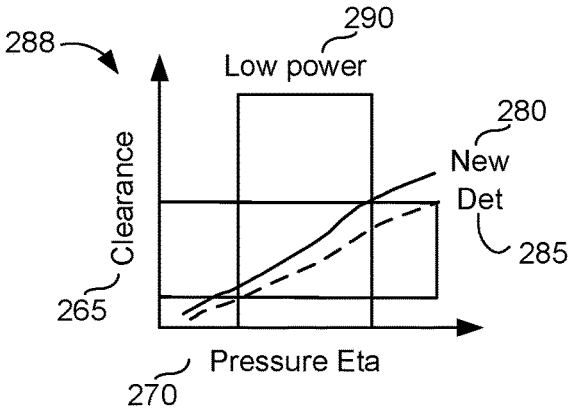
FIG. 2F illustrates an example conversion curve determined using clearance and pressure efficiency based on the one-point pressure measurement of FIGS. 2A-2D during low power operation.

FIG. 2E illustrates an example conversion curve 264 determined at example high-power level 275 using example clearance 265 and example pressure efficiency 270 measurements based on the one-point pressure measurements of FIGS. 2A-2B and/or FIGS. 2C-2D for a new blade and/or a blade with tip loss. Similarly, an example conversion curve 288 of FIG. 2F is determined at example low-power level 290 based on the one-point pressure measurement of FIGS. 2A-2B and/or FIGS. 2C-2D for a new blade and a blade with tip loss. As such, conversion curves can be determined for different power levels (e.g., high, low, etc.) and/or different altitudes (e.g., low, mid, high, etc.). To determine conversion curves based on the one-point pressure measurements (e.g., $P_T$, $P_S$, etc.) of FIGS. 2A-2B and/or FIGS. 2C-2D, a normalized equation for pressure efficiency (Pη) can be determined by calculating the ratio of static pressure ($P_S$) to total pressure ($P_T$), where $P_T$ serves as a reference point. Use of normalized pressure efficiency allows for the Pη output value(s) to range from 0-1 (unitless).

Based on the pressure efficiency calculations, the conversion curves 264, 288 of FIGS. 2E-2F can be determined with specific clearance 265 measurements identified at a given value of Pη. For example, Pη can range from 0.80-0.90 (normalized value) under a given set of conditions, while clearance 265 measurements can range from 0-40 mils (e.g., were 1 mil corresponds to one thousandth of an inch). Over time, as Pη value range increases, the clearance 265 range can show a corresponding increase after numerous flights. As such, conversion curves can be developed at various conditions (e.g., altitudes, power levels, flight numbers, etc.). As shown in the example of FIG. 2F, the Pη to clearance conversion curve 288 shows a lower slope of the curve 280 for a new engine at low power 290 as compared to the conversion curve 264 of FIG. 2E, corresponding to the lower overall temperatures that the system is exposed to at low power 290 compared to high power 275, which translates to overall lower clearance 265 values. In addition to conversion curves obtained during new engine testing, such curves can also be obtained for deteriorated engine conditions (e.g., engines with rotor blade 164, 168 tip loss). As shown in the example of FIGS. 2E-2F, the conversion curve for a deteriorated engine 285 falls below the conversion curve for a new engine 280. As described in more detail in connection with FIGS. 3C-3D, the conversion curve for a deteriorated engine 285 can be determined based on blade tip loss as measured using the methods described herein.

Figure 3A:
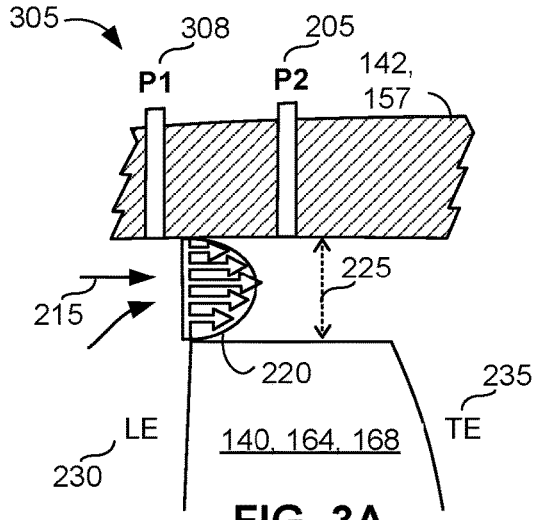
FIG. 3A illustrates an example two-point pressure measurement at a first location showing airflow when radial tip clearance is increased.
Figure 3B:
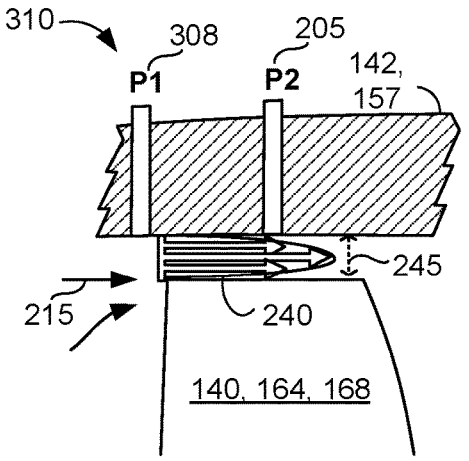
FIG. 3B illustrates an example two-point pressure measurement showing airflow when radial tip clearance is decreased.

FIG. 3A illustrates an example two-point pressure measurement 305 at the first location 205 of FIGS. 2A-2D and a second location 308 showing airflow 215 when radial tip clearance 225 is increased. FIG. 3B illustrates an example two-point pressure measurement 310 showing airflow 215 when radial tip clearance 245 is decreased. Compared to FIGS. 2A-2B described above, the two-point pressure measurement(s) 205, 308 permit more than one measurement to be used in the determination of the pressure efficiency (Pη) calculation. While the one-point pressure measurement of FIG. 2 relies on a static pressure measurement and a total pressure measurement, a multi-point pressure measurement (e.g., a two-point and/or a three-point pressure measurement) relies on static pressure measurements (e.g., at one or more locations using a static pressure transducer). As such, the normalized pressure efficiency (Pη) can be calculated in accordance with Equation 1:

$$P\eta=(P_{high}-P_{S_local})/(P_{high}-P_{low}) \quad \text{(Equation 1)}$$

In the example of Equation 1, $P_{high}$ represents the maximum pressure attained in the system (e.g., combustor pressure at upstream), $P_{low}$ represents the lowest pressure attained in the system during measurement (e.g., an aft pressure measurement), while $P_{S_local}$ represents the local static pressure measurement ($P_S$). In some examples, Equation 2 can be used to determine the normalized pressure efficiency (Pη), depending on the positioning of the static pressure measurement sensors:

$$P\eta=(P_{high}-P_{S_forward})/(P_{high}-P_{S_aft}) \quad \text{(Equation 2).}$$

In the example of Equation 2, $P_{high}$ represents the maximum pressure attained in the system (e.g., combustor pressure at upstream), $P_{S_aft}$ represents the static pressure measured downstream of the airflow 215 as represented by flow profile 220 (e.g., an aft pressure measurement), while $P_{S_forward}$ represents the static pressure measured upstream of the airflow 215 as represented by flow profile 220. Since a one-point pressure measurement requires measurement of both total pressure and static pressure, pressure sensor(s) used for such measurements can require designs that are able to withstand harsh environments found in a turbine engine (e.g., high pressure turbine, etc.). As such, as described in connection with the methods disclosed herein, a one-point pressure measurement system can require pressure sensors with higher tolerance levels, unlike multi-pressure measurements (e.g., two-point and/or three-point measurements of FIGS. 3 and 4) that can use conventional statis pressure sensors. Methods and apparatus disclosed herein permit the use of such conventional pressure sensors for real-time clearance assessment, without requiring the need for more advanced sensor designs. In some examples, relevant to the one-point pressure measurements as shown in FIG. 2, optical sensors can produce highly accurate measurements and have a long operating life but can require cooling flow or material improvements to withstand turbine-based temperature limits of 1,000 degrees Celsius. For example, an optical sensor (e.g., an intensity-based optical pressure sensor, etc.) can have a long service life (e.g., over 20,000 flight hours), be able to capture pressures of 150 pounds per square inch (psi)-1,000 psi, and withstand temperatures of approximately 1,000 degrees Celsius without the need for active cooling via gas path components. In some examples, sensor-based measurement points and/or locations (e.g., one-point measurement, two-point measurement, three-point measurement, etc.) can be based on air-filled pipes (e.g., sense lines), which can be used indicate pressure variation at the selected measurement point(s).

Based on the measured total pressure and static pressure obtained during a one-point pressure measurement, conversion curves can be generated for a new engine and/or an engine with some deterioration resulting from longer usage and exposure to high combustive gas temperatures (e.g., reduced blade tip, etc.), as described in connection with FIGS. 2A-2F. For example, engine removal from service can result from a spent exhaust gas temperature (EGT) margin due to high pressure turbine component deterioration, with increased blade tip clearance being a major factor in degradation of hot section engine components. For example, as engine components degrade and clearances increase, an engine's internal temperature increases as it becomes hotter to achieve the same level of thrust. An engine that has reached its EGT limit is an indication of a high-pressure turbine's disk reaching its upper limit for temperature, causing the engine to come off the wing for costly maintenance work. As such, blade tip clearance management is critical to ensure improved engine efficiency, stability, and overall service life. Real-time clearance assessment as described using the methods disclosed herein based on pressure measurement(s) and usage of conversion curves allows for an engine's active clearance control (ACC) system to receive real-time input on the clearance not only for a new engine, but also an engine that has already started to show signs of deterioration (e.g., reduced tip blade). This allows the ACC system to properly adjust the clearance (e.g., via opening and/or closing the clearance) and thereby improve engine efficiency, permitting a longer service life, as described in connection with FIG. 5. Blade tip reduction and resulting pressure measurements that can be obtained to permit conversion curve development for a deteriorated engine are described in more detail in connection with FIGS. 3C-3D below.

Figure 3C:
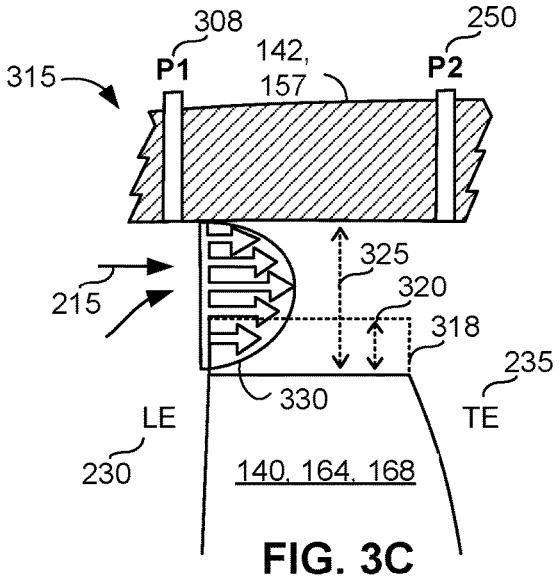
FIG. 3C illustrates an example two-point pressure measurement after blade tip loss has occurred, showing airflow when radial tip clearance is increased.
Figure 3D:
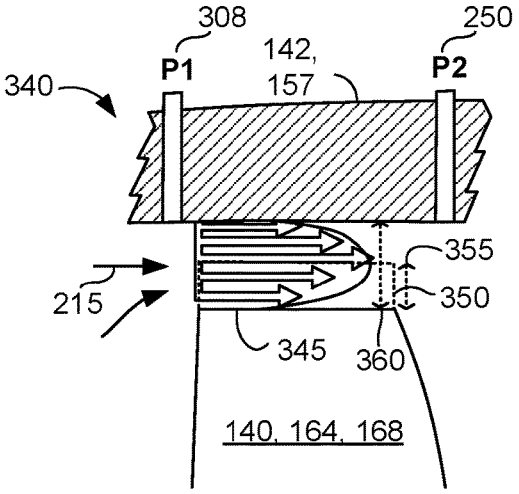
FIG. 3D illustrates an example two-point pressure measurement after blade tip loss has occurred, showing airflow when radial tip clearance is decreased.

FIG. 3C illustrates an example two-point pressure measurement 315 after fan blade 140 and/or rotor blade 164, 168 tip loss has occurred, showing an example airflow profile 330 when example radial tip clearance 325 is increased. FIG. 3D illustrates an example two-point pressure measurement 340 after blade 140, 164, 168 tip loss has occurred, showing an example airflow profile 345 when example radial tip clearance 360 is decreased. In the example of FIG. 3C, an original length 318 of the blade 140, 164, 168 tip shows a total reduction 320 as a result of blade 140, 164, 168 tip loss. Such a tip loss can occur due to rub, oxidation, erosion, corrosion, and/or coating fatigue. As such, blade tip reduction results in clearance gaps and overall clearance changes that alter airflow in the engine—affecting operating behavior, fuel consumption, and/or performance. While too much clearance can result in increased internal leakages contributing to thrust losses, fuel consumption increase, and/or temperature increase in hot gas flow, insufficient clearance can cause blade 140, 164, 168 rubbing against the casing 142, 157 (e.g., a shroud). Such rubbing can result in rotor blade failure (e.g., dynamic fatigue), overheating, and/or damage to surfaces exposed to the rubbing. As previously described, an engine's FADEC system can control engine performance digitally, including calculating tip clearances in operating conditions to allow ACC-based tip clearance optimization. However, the FADEC system calculations rely on "new" tip blade clearance associated with tip blades that do not have any tip loss due to operating conditions (e.g., rub, oxidation, etc.). Such new blade-based pressure measurements can be obtained as described in connection with FIGS. 2A-2D and/or 3A-3B to obtain the example conversion curve 370 of FIG. 3E. However, to allow the ACC-based tip clearance to be effectively optimized and/or otherwise improved, real-time clearance measurements can be obtained, as described in connection with FIG. 5. To obtain such real-time measurements, conversion curves can also be obtained for blades with ongoing degeneration (e.g., blade tip loss), which occurs gradually over engine cycles and overall engine lifetime. FIGS. 3C-3D illustrate two-point pressure measurements for blades with tip loss, thereby allowing conversion curve development that considers blade tip reduction over time.

In the example of FIG. 3C, a two-point pressure measurement can be obtained at locations 250, 308. However, any other pressure-based measurement location can be used (e.g., 205, 250, and/or 308). Opening of the clearance (e.g., via active clearance control) introduces a larger clearance gap 325 compared to the clearance 225 of FIG. 3A in the absence of blade 140, 164, 168 loss (e.g., as shown by example blade tip reduction 320 from the original blade length 318). This causes a change in the airflow path, as there is increased airflow of combustive gases as shown by the flow profile 330, compared to the original flow profile 220 without presence of blade tip loss. As such, tip clearance can affect not only the resulting flow fields but also heat transfer performance. Likewise, in the example of FIG. 3D, airflow profile 345 in the presence of blade 140, 164, 168 tip loss (e.g., as shown by blade tip reduction 355 from the original blade length 350) for a closed clearance (e.g., with clearance gap 360) is increased compared to the airflow profile 240 of FIG. 3B in the absence of blade 140, 164, 168 tip loss. As such, the real-time clearance gap 360 can be larger in the presence of blade 140, 164, 168 with tip loss (e.g., tip reduction(s) 320, 355) than the desired clearance gap 245 which is achieved using ACC when blade tip loss is not taken into consideration when determining the optimal clearance. By developing calibration curves that account for blade tip reduction(s) 320, 355 based on pressure measurements at one or more locations (e.g., locations 205, 250, and/or 308), ACC-based clearance modulation can be adjusted to reflect real-time blade tip conditions, thereby achieving a desired clearance gap (e.g., clearance gap(s) 225, 245) instead of clearance gaps(s) that are larger than intended (e.g., clearance gap(s) 325, 360).

Figure 3E:
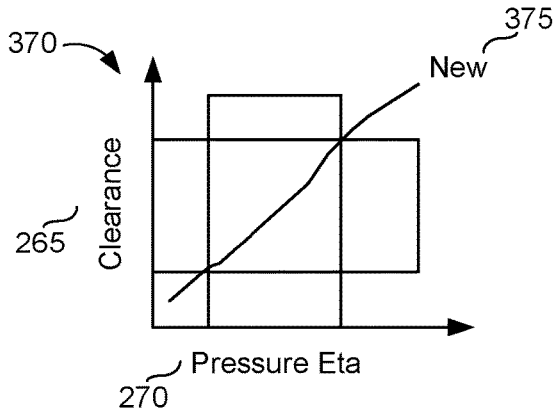
FIG. 3E illustrates an example conversion curve determined using clearance and pressure efficiency based on the two-point pressure measurement of FIGS. 3A-3B for a new blade.
Figure 3F:
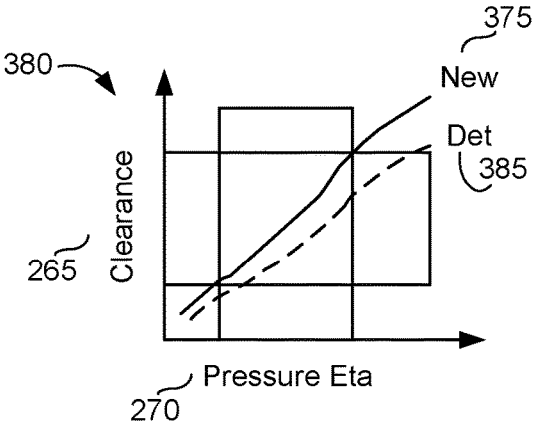
FIG. 3F illustrates an example conversion curve determined using clearance and pressure efficiency based on the two-point pressure measurement of FIGS. 3C-3D for a blade with tip loss.

FIG. 3E illustrates an example conversion curve 370 determined using clearance 265 and pressure efficiency 270 based on the two-point pressure measurement(s) of FIGS. 3A-3B for a new (non-deteriorated) blade 140, 164, 168. FIG. 3F illustrates an example conversion curve 380 determined using clearance 265 and pressure efficiency 270 based on the two-point pressure measurement of FIGS. 3C-3D for a blade 140, 164, 168 with tip loss (deteriorated). As previously described in connection with FIG. 3A, Equations 1 and 2 can be used to determine two-point pressure measurements (e.g., using two local static pressures) based on the locations of static pressure sensors (e.g., locations 308, 205 and/or locations 308, 250 of FIGS. 3A-3B and/or FIGS. 3C-3D, respectively). The velocity of the airflow for flow profile 225 of FIG. 3A will vary from the velocity of the airflow for flow profile 330 of FIG. 3C due to tip reduction 320. As such, the pressure efficiency (Pη) (e.g., pressure eta 270) to clearance (e.g., clearance 265) conversion curve 370 of FIG. 3E for a new engine 375 (e.g., non-deteriorated engine without blade tip loss) differs from the conversion curve 380 of FIG. 3D which includes a conversion curve for a deteriorated engine 385 (e.g., engine with blade tip loss). Availability of both conversion curves (e.g., for a new engine 375 and a deteriorated engine 385) permits determination of clearance 265 for an engine at different life cycle stages which cause variations in pressure 270.

Figure 4A:
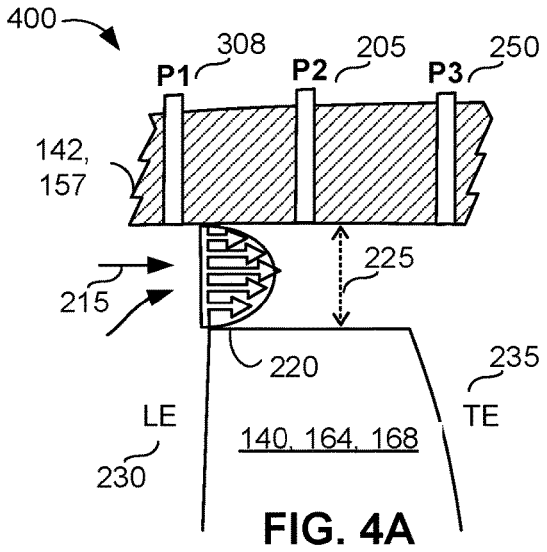
FIG. 4A illustrates an example three-point pressure measurement showing airflow when radial tip clearance is increased.
Figure 4B:
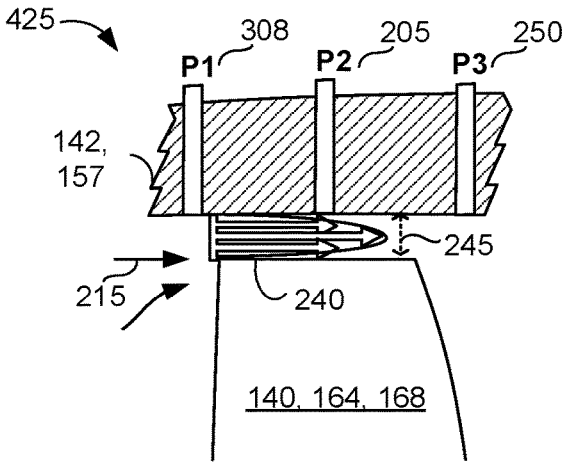
FIG. 4B illustrates an example three-point pressure measurement showing airflow when radial tip clearance is decreased.

FIG. 4A illustrates an example three-point pressure measurement 400 showing airflow profile 220 when radial tip clearance 225 is increased. FIG. 4B illustrates an example three-point pressure measurement 425 showing airflow profile 245 when radial tip clearance 245 is decreased. In FIGS. 4A-4B, an example of a three-point pressure measurement (e.g., front (P1), mid (P2), and aft (P3)) is shown to illustrate that any of the previous measurement locations (e.g., locations 308, 205, 250) can be used for a multi-point pressure measurement that tracks variation(s) in static pressure (e.g., based on airflow 215 velocity as illustrated using flow profile(s) 220, 240) during ACC-based clearance opening (e.g., clearance gap 225) versus ACC-based clearance closure (e.g., clearance gap 245). For example, P2 for a mid-based measurement will produce a different output based on pressure changes and/or flow profile changes. As such, multiple pressure point measurements can allow for development of more accurate conversion curves (e.g., conversion curves 450, 475 of FIGS. 4C-4D) at various operating conditions (e.g., various altitudes, power levels, etc.) and blade tip loss can be assessed based on offsets from the conversion curves developed for a new engine during ground and/or flight testing. For example, pressure measurements can be obtained using one or more sensors. In some examples, multi-point based pressure measurements can rely on simple conventional static pressure sensors. In some examples, any other type of pressure sensor can be used (e.g., optical, laser, capacitive, Eddy current, microwave, etc.). For example, use of a pressure sensor in harsh environments (e.g., a high pressure turbine) requires a pressure sensor design that can withstand the harsh environment of a turbine engine and includes a robust design, long operating life, high vibration and impact tolerance, ease of maintenance, no need for cooling flow during operation, improved signal to noise ratio, and/or has a low cost appropriate for production engines.

Figure 4C:
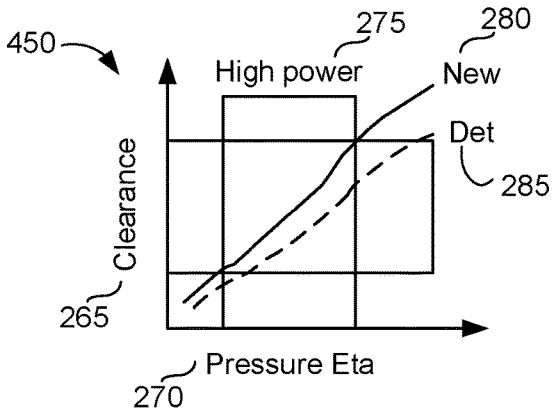
FIG. 4C illustrates an example conversion curve determined using clearance and pressure efficiency based on the three-point pressure measurement of FIGS. 4A-4B for a new blade and a blade with tip loss during high power operation.
Figure 4D:
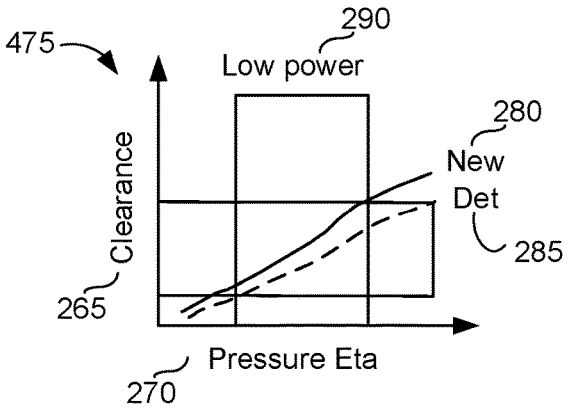
FIG. 4D illustrates an example conversion curve determined using clearance and pressure efficiency based on the three-point pressure measurement of FIGS. 4A-4B for a new blade and a blade with tip loss during low power operation.

FIG. 4C illustrates an example conversion curve 450 determined at high power 275 operation using clearance 265 and pressure efficiency 270 based on the three-point pressure measurement(s) 400, 425 of FIGS. 4A-4B, including a conversion curve for a new engine 280 and a deteriorated engine 285 with tip loss. FIG. 4D illustrates an example conversion curve 475 determined at low power 290 operation using clearance 265 and pressure efficiency 270 based on the three-point pressure measurement(s) 400, 425 of FIGS. 4A-4B for a new engine 280 and an engine with deterioration 285 (e.g., blade tip loss). For example, during operation, the engine's FADEC system and associated ACC system can determine blade tip loss based on offset of the conversion curve for a deteriorated engine 285 from the conversion curve for the new engine 280 developed when a new engine is being tested either on the ground and/or in flight (e.g., a high power 275 and/or low power 290). This allows the ACC system to correct clearance gap(s) 225, 245 in the event of blade 140, 164, 168 tip loss, as described in connection with FIG. 5.

Figure 5:
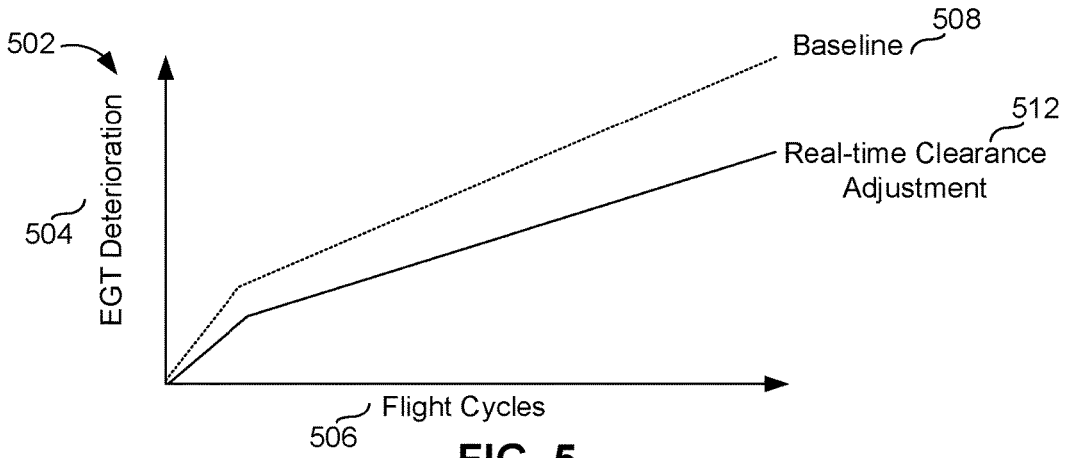
FIG. 5 illustrates an example measurement of exhaust gas temperature (EGT) deterioration over multiple flight cycles using a baseline measurement compared to a real-time measurement achieved using the methods disclosed herein.

FIG. 5 illustrates an example measurement 502 of exhaust gas temperature (EGT) deterioration 504 over multiple flight cycles 506 using an example baseline measurement 508 compared to a real-time clearance adjustment 512 achieved using the methods disclosed herein. As previously described, EGT can be used as an indicator of whether an engine needs to come off a wing for maintenance due to deterioration and/or has reached its maximum service capacity. As such, EGT allows for management and diagnosis of the engine and provides protection of engine components that are sensitive to thermal overloads. In the example of FIG. 5, EGT refers to a temperature of turbine exhaust gases during exit from the turbine unit, the temperature measured using thermocouples mounted in the exhaust stream. Active clearance control maintains optimal clearance in part to ensure that EGT remains below its limit, thereby improving engine efficiency and time-on-wing. Likewise, tighter blade tip clearances are maintained to reduce air leakage over blade 140, 164, 168 tips, otherwise rotor inlet temperatures are increased to achieve the same level of performance and hot section components experience a reduced life cycle due to the temperature increases (e.g., thermal fatigue) to produce the same amount of work. Furthermore, maintenance costs can be reduced by ensuring engine efficiency through optimized tip clearances via ACC. In the example of FIG. 5, increased number of flight cycles 506 results in higher EGT deterioration 504, which includes blade tip loss. Using a baseline measurement 508, a new engine can be estimated to have a certain level of EGT deterioration 504 by a given number of flight cycles 506. However, such a baseline measurement 508 is not necessarily representative of actual EGT deterioration 504 for a given engine over time.

Figure 6A:
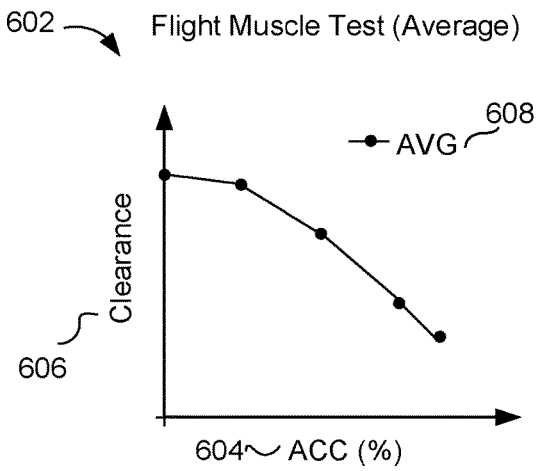
FIG. 6A illustrates an example change in clearance with increasing active clearance control based on a measurement of a mid-seal static pressure at forward and aft cavities.
Figure 6B:
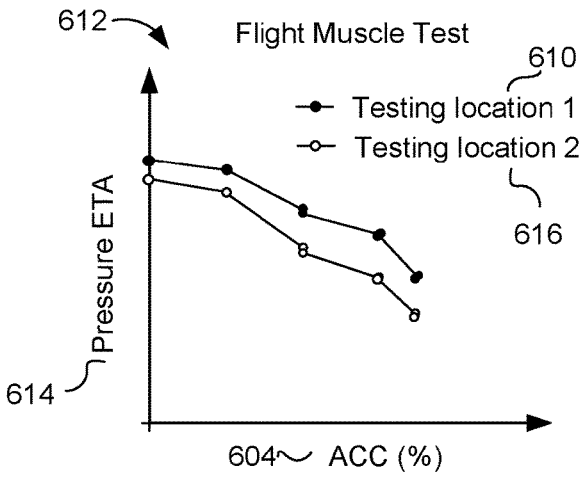
FIG. 6B illustrates an example change in pressure efficiency measurement with increasing active clearance control based on measurements of a mid-seal static pressure at forward and aft cavities.
Figure 6C:
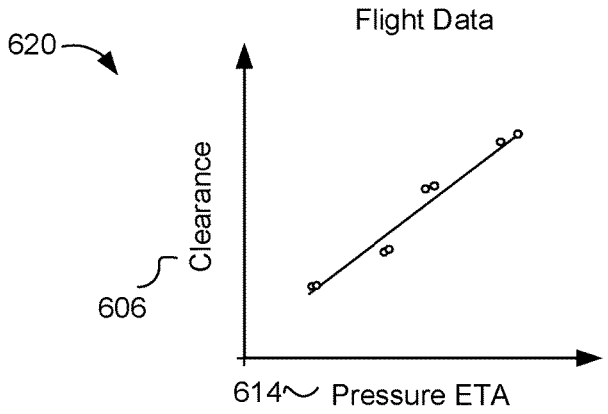
FIG. 6C illustrates an example linear correlation between clearance and pressure efficiency based on the measurements of FIGS. 6A-6B obtained for flight data at a cruise point.

As shown in the example of FIG. 5, rates of EGT deterioration are highest during initial operation, with subsequent stabilization to reach a steady state level (e.g., baseline measurement 508). For example, the baseline measurement 508 can indicate an installation loss for EGT deterioration of 25 degrees Celsius for the first 2,000 flight cycles, compared to a steady state loss of approximately 5 degrees Celsius for each 1,000 flight cycles after initial operation. Unlike mature engines, first-run engines (e.g., new engines) have a higher EGT margin and lower EGT deterioration rates. Borescope inspection (BSI) can provide a manual method of determining engine deterioration. Such an inspection can be used to re-set the EGT deterioration 504 measurement as shown in the example of FIG. 5 (e.g., through proper maintenance and/or replacement of parts, etc.). However, BSI is manually intensive for tip notch inspection, may not guarantee high-quality data, and requires manual tracking rather than an automatic solution that can be implemented in real-time. Conversely, a real-time clearance adjustment 512 can decrease EGT deterioration by permitting optimized ACC-based clearance modulation based on the real-time state of the engine (e.g., blade tip loss progression). As previously described, pressure to clearance conversion curves can be developed to permit identification of offsets from the conversion curve which correspond to engine degeneration. FIGS. 6A-6C further describe the determination of clearance versus pressure conversion curves during engine-based testing (e.g., ground testing and/or flight testing).

FIG. 6A illustrates an example graph 602 showing a change in clearance with increasing active clearance control based on a measurement of a mid-seal static pressure at forward and aft cavities. In the example of FIG. 6A, clearance 606 is decreased as ACC 604 is engaged (e.g., resulting in reduced clearance gap 245 of FIG. 2A). For example, the ACC system includes a butterfly valve that moves in various angles to change the amount of cooling flow for the containment structure 142 (e.g., a shroud), thereby controlling the structure's expansion and/or contraction and maintaining an accurate clearance between the containment structure 142 and the blade tip. As such, the ACC 604 valve can be fully closed (0%), partially opened, or fully opened (100%). In the example of FIG. 6A, increased ACC 604 results in decreased clearance 606, as shown using an average measurement 608 obtained using multiple tests. FIG. 6B illustrates an example graph 612 showing a change in pressure efficiency 614 (e.g., based on static pressure measurements for a multi-point pressure measurement of FIGS. 3 and 4) with increasing ACC 604 based on two testing location(s) 610, 616. In the example of FIG. 6B, pressure efficiency ($P\eta$) decreases with increasing ACC 604 for both testing location(s) 610, 616. In some examples, the testing location(s) can correspond to the forward, mid, and/or aft locations 308, 205, and/or 250 of FIGS. 2, 3, and/or 4. Based on FIGS. 6A and 6B, a conversion curve can be developed as shown in FIG. 6C (e.g., based on flight data obtained at a cruise point), which illustrates an example linear correlation 620 between clearance 606 and pressure efficiency 614. The linear correlation 620 indicates that an increase in pressure efficiency 614 results in a corresponding increase in clearance 606, as previously shown using the conversion curve(s) 264, 288, 370, 380, 450, 475 of FIGS. 2, 3, and/or 4. The example conversion curve 620 of FIG. 6C can be developed during engine ground testing and/or flight testing, including at varying altitudes and/or power levels (e.g., at variable crank shaft rotations, such as 16,400 revolutions per minute (rpm)).

Figure 7:
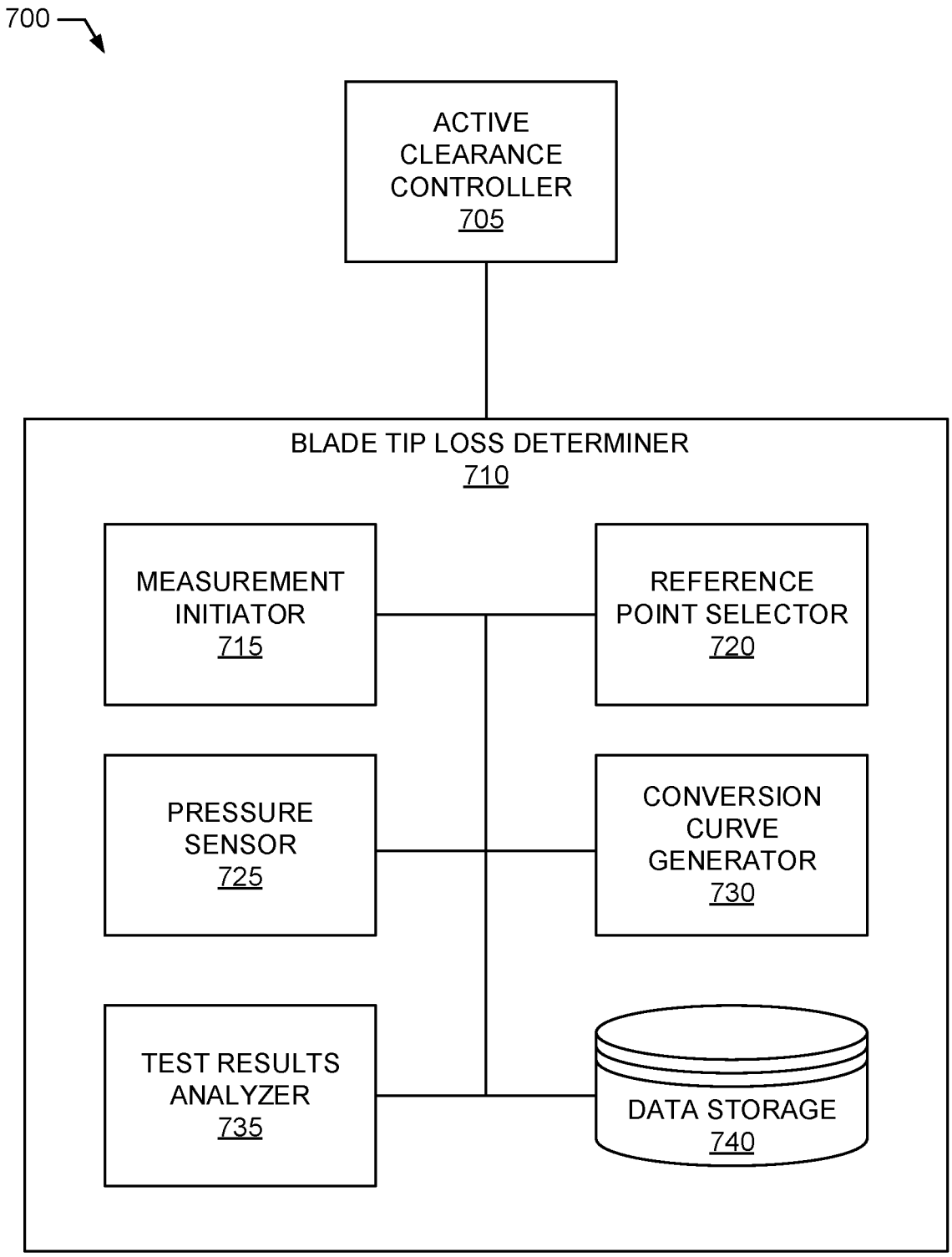
FIG. 7 is a block diagram of an example implementation of a blade tip loss determiner by which the examples disclosed herein can be implemented.

FIG. 7 is a block diagram 700 of an example implementation of a blade tip loss determiner 710 by which the examples disclosed herein can be implemented. In the example of FIG. 7, an active clearance controller 705 is in communication with the blade tip loss determiner 710. The example blade tip loss determiner 710 includes a measurement initiator 715, a reference point selector 720, a pressure sensor 725, a conversion curve generator 730, a test results analyzer 735, and a data storage 740.

The active clearance controller 705 is part of the Full Authority Digital Engine Control (FADEC) system used to maintain tight blade tip clearance to reduce leakage of hot gases and improve engine performance (e.g., fuel burn, life cycle, service life, etc.). The controller 705 permits real-time modulation of turbine clearances. For example, the controller 705 can actuate a butterfly valve (e.g., via the FADEC system) to distribute cooling air around the engine (e.g., the casing and/or containment structure 142, 157 of FIG. 1), thereby causing contraction of the structure to control the blade tip clearance (e.g., blade tip clearance gap(s) 225, 245 of FIG. 2). In some examples, the controller 705 maintains circumferentially uniform clearances given engine-to-engine manufacturing variability and real-time loading effects on the engine structural components. In some examples, an actuation mechanism of the controller 705 moves casing 142, 157 parts (e.g., shrouds) against large pressure differentials (e.g., 100-200 pound-force per square inch (PSI)) to permit clearance opening (e.g., as illustrated in FIGS. 2A, 2C, 3A, 3C, and/or 4A) and/or clearance closing (e.g., as illustrated in FIGS. 2B, 2D, 3B, 3D, and/or 4B). In the example of FIG. 7, the controller 705 receives input from the blade tip loss determiner 710 to achieve tight clearances based on pressure measurements obtained in real-time. This allows the controller 705 to modify the clearance accordingly, even in the presence of blade tip loss, which can result in larger than intended clearances (e.g., as shown in the examples of FIGS. 3C-3D for clearance gap(s) 325, 360).

The blade tip loss determiner 710 can be used during initial testing of engines to develop conversion curve(s) 264, 288, 370, 450, 475, and/or 620 at varying power levels and/or altitudes, as well as during in-flight monitoring of clearances by the controller 705 in order to make real-time clearance adjustments that are reflective of the state of the engine (e.g., progressive blade tip loss). The blade tip loss determiner 710 includes a measurement initiator 715 to determine when a pressure-based measurement (e.g., a one-point, two-point, and/or a three-point pressure measurement) is needed (e.g., during testing and/or in-flight data collection). In some examples, the measurement initiator 715 initiates a pressure measurement using one or more sensor(s) (e.g., a conventional static pressure sensor, an optical sensor, a laser-based sensor, a capacitive sensor, an Eddy current sensor, a microwave sensor, etc.). In some examples, the measurement initiator 715 initiates a measurement at an aft, a mid, and/or a front location relative to a given clearance gap, as determined based on the direction of combustive gas airflow (e.g., airflow 215 of FIG. 2). In some examples, during initial testing to develop conversion curves that correlate pressure to clearance measurements, the measurement initiator 715 can determine when to initiate pressure measurement(s) based on a given power level (e.g., low power, high power), a specific altitude (e.g., at 35 kilofeet, etc.), and/or a specific flight cycle.

The reference point selector 720 determines whether a one-point measurement (e.g., as illustrated in FIG. 2), a two-point measurement (e.g., as illustrated in FIG. 3), and/or a three-point measurement (e.g., as illustrated in FIG. 4) is performed. In some examples, the total number of reference points used for the pressure measurement(s) can be determined based on a type of engine and/or other parameters such as altitude, flight cycle, and/or power level. In some examples, a multi-point measurement (e.g., a three-point measurement) can introduce greater accuracy to the final conversion curve(s) developed based on the obtained data. In some examples, the reference point selector 720 determines the location of the reference points to be used for obtaining pressure measurements during testing and/or in-flight. For example, as illustrated in FIGS. 2A-2D, a one-point pressure measurement can be based on a forward (e.g., upstream), mid, and/or aft (e.g., downstream) location (e.g., locations 205, 250) and/or can require a static pressure and a total pressure measurement. As such, selection of a one-point or a multi-point pressure measurement can be based on whether a total pressure measurement can be acquired (e.g., depending on type of pressure sensor(s) being used). For example, the measurement of a total pressure can require sensors that are more durable (e.g., an optical sensor with cooling flow), while multi-point pressure measurements can be based on local static pressures that can be obtained using conventional static pressure sensors. As illustrated in FIGS. 3A-3D, a two-point measurement can similarly be based on designated locations and/or reference points (e.g., locations 308, 205, and/or 250). As such, the reference point selector 720 can identify the locations to be used for pressure-based measurements, which can depend on the positioning of the pressure sensor(s) 725.

The pressure sensor 725 can be designed to withstand the harsh environment of a turbine engine, have a long operating life, high vibration and impact tolerance, ease of maintenance, no need for cooling flow during operation, an improved signal to noise ratio, and/or a low cost appropriate for production engines (e.g., include cooling technology for increased sensor life span). Such an advanced pressure sensor can be used for one-point based pressure measurements, as described in connection with FIG. 2. However, a multi-point pressure measurement can be obtained using local static pressure measurements (e.g., using conventional pressure sensors). In some examples, the pressure sensor(s) 725 (e.g., static pressure sensor(s)) can be mounted on any region of the engine allowing access to pressure measurements for the clearance gaps with reliable data collection. In some examples, the pressure sensor 725 can include a transducer used to convert the pressure measurement to an electrical signal that is transmitted to the controller 705. In some examples, the pressure sensor 725 can be positioned in a relatively cool position on the engine casing (e.g., casing 157 surrounding the LP turbine rotor blades 164 and/or the HP turbine rotor blades 168) to avoid high temperature-induced damage at the location where the pressure measurement is being collected. For example, the pressure sensor 725 can sense engine pressure via air-filled pipes (e.g., sense lines), which can indicate pressure variation at the point of interest. In some examples, the pressure sensor 725 can be mounted directly to the region of interest to collect the desired data without the need for sense lines. In some examples, the pressure sensor 725 can be used to obtain various pressure measurements, including static pressure, a maximum pressure ($P_{high}$) (e.g., combustor pressure at upstream), and/or a lowest pressure ($P_{low}$) (e.g., an aft pressure measurement).

The conversion curve generator 730 generates conversion curves (e.g., conversion curve(s) 264, 288, 370, 450, and/or 475 of FIGS. 2, 3, and/or 4) to determine the relationship between pressure efficiency (Pη) and clearance. For example, the conversion curve generator 730 receives input from the pressure sensor(s) 725 and uses Equations 1-2 (e.g., for a multi-point pressure measurement) as described in connection with FIGS. 2-3 to determine a normalized equation for pressure efficiency (Pη). As such, a particular clearance (mils) can be determined based on the obtained pressure measurements, allowing for the development of a conversion curve that can be used by the blade tip loss determiner 710 to identify offset(s) from the curve (e.g., due to blade tip loss) and thereby communicate the offsets to the controller 705 to achieve a more accurate clearance gap adjustment based on real-time pressure data, as described in connection with FIG. 10.

The test results analyzer 735 determines changes in pressure measurements obtained using the pressure sensor(s) 725 and/or identifies offsets from the conversion curves generated using the conversion curve generator 730. For example, as the engine deteriorates and blade tip loss occurs, any offset from the conversion curve(s) developed for a new engine (e.g., as identified in sample conversion curves 2E-2F of FIG. 2) can be determined, allowing real-time blade 140, 164, 168 tip loss assessment. In some examples, the test results analyzer 735 provides the controller 705 with the real-time clearance measurement that takes into account blade tip loss progression, allowing the controller 705 to adjust the clearance accordingly based on the observed blade tip loss, avoiding the presence of a larger clearance gap (e.g., as illustrated in the example of FIGS. 3C-3D using clearance gap(s) 325, 360) and instead achieving the targeted and/or optimized clearance to ensure engine efficiency.

The data storage 740 can be used to store any information associated with the blade loss determiner 710. For example, the database 740 can store pressure measurements obtained using one or more pressure sensor(s) 725, conversion curve(s) generated using the conversion curve generator 730, and/or test results analyzer 735 output used by the controller 705 to make clearance adjustments based on real-time data. The example data storage 740 of the illustrated example of FIG. 7 is implemented by any memory, storage device and/or storage disc for storing data such as flash memory, magnetic media, optical media, etc. Furthermore, the data stored in the example data storage 740 can be in any data format such as binary data, comma delimited data, tab delimited data, structured query language (SQL) structures, image data, etc.

While an example implementation of the blade tip loss determiner 710 is illustrated in FIG. 7, one or more of the elements, processes and/or devices illustrated in FIG. 7 may be combined, divided, re-arranged, omitted, eliminated and/or implemented in any other way. Further, the example measurement initiator 715, the example reference point selector 720, the example pressure sensor 725, the example conversion curve generator 730, the example test results analyzer 735, and/or, more generally, the example blade tip loss determiner 710 of FIG. 7 may be implemented by hardware, software, firmware and/or any combination of hardware, software and/or firmware. Thus, any of the example measurement initiator 715, the example reference point selector 720, the example pressure sensor 725, the example conversion curve generator 730, the example test results analyzer 735, and/or, more generally, the example blade tip loss determiner 710 of FIG. 7 can be implemented by one or more analog or digital circuit(s), logic circuits, programmable processor(s), programmable controller(s), graphics processing unit(s) (GPU(s)), digital signal processor(s) (DSP(s)), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example measurement initiator 715, the example reference point selector 720, the example pressure sensor 725, the example conversion curve generator 730, the example test results analyzer 735, and/or, more generally, the example blade tip loss determiner 710 of FIG. 7 is/are hereby expressly defined to include a non-transitory computer readable storage device or storage disk such as a memory, a digital versatile disk (DVD), a compact disk (CD), a Blu-ray disk, etc. including the software and/or firmware. Further still, the example blade tip loss determiner 710 of FIG. 7 may include one or more elements, processes and/or devices in addition to, or instead of, those illustrated in FIG. 7, and/or may include more than one of any or all of the illustrated elements, processes and devices. As used herein, the phrase "in communication," including variations thereof, encompasses direct communication and/or indirect communication through one or more intermediary components, and does not require direct physical (e.g., wired) communication and/or constant communication, but rather additionally includes selective communication at periodic intervals, scheduled intervals, aperiodic intervals, and/or one-time events.

Figure 8:
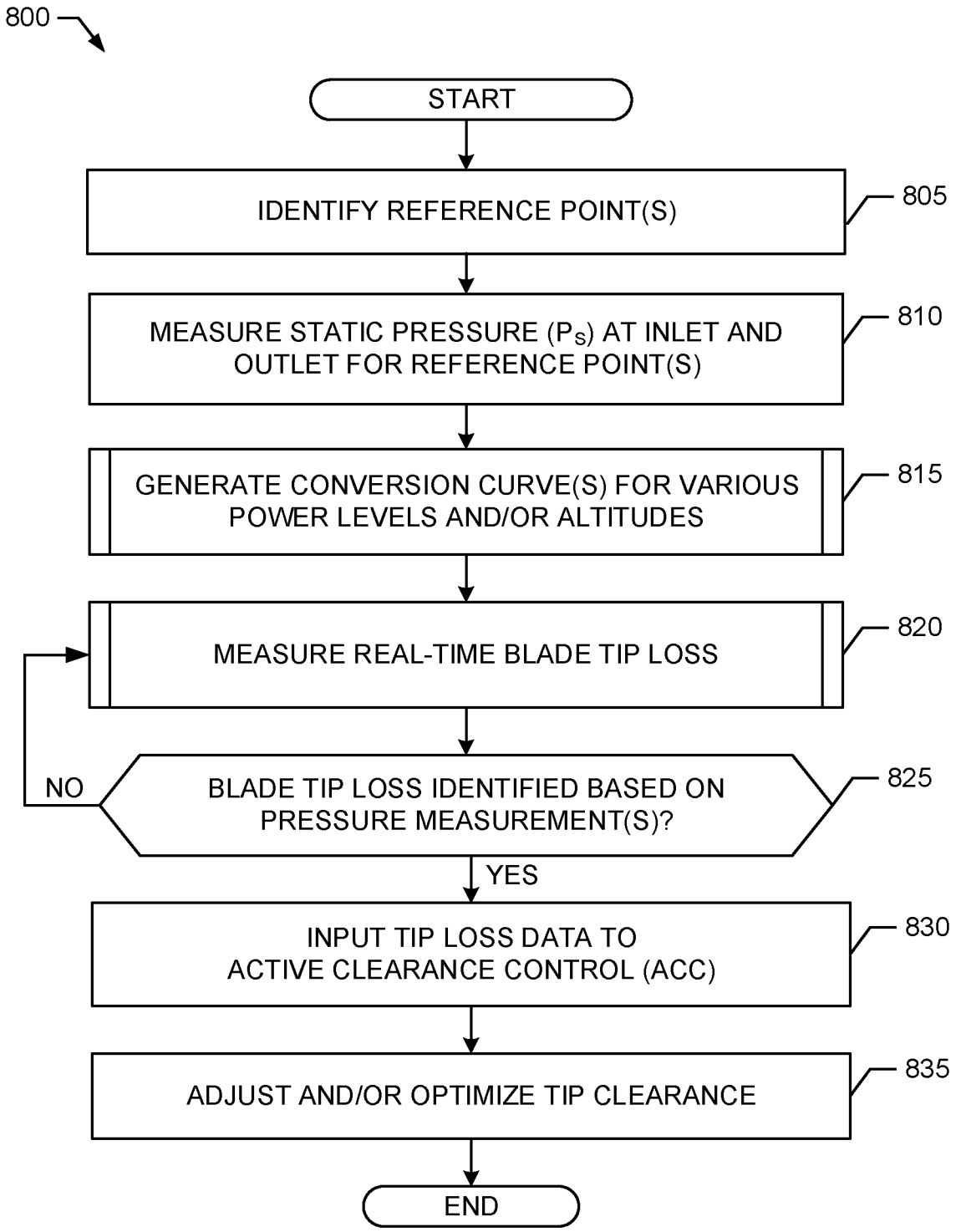
FIG. 8 illustrates a flowchart representative of example machine readable instructions which may be executed to implement the example blade tip loss determiner of FIG. 7.
Figure 9:
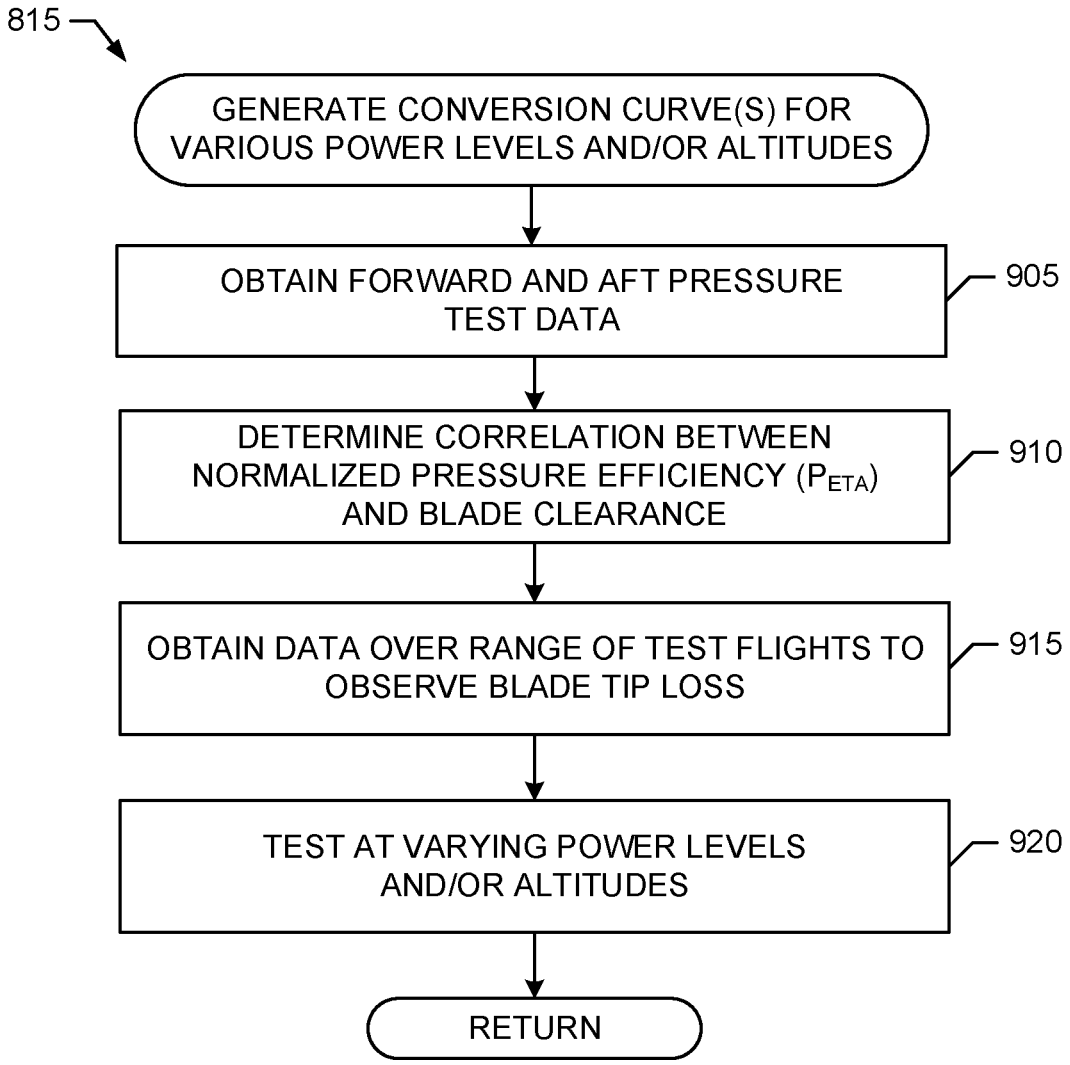
FIG. 9 illustrates a flowchart representative of example machine readable instructions which may be executed to generate conversion curve(s) for various power levels and/or altitudes using the example blade tip loss determiner of FIG. 7.
Figure 10:
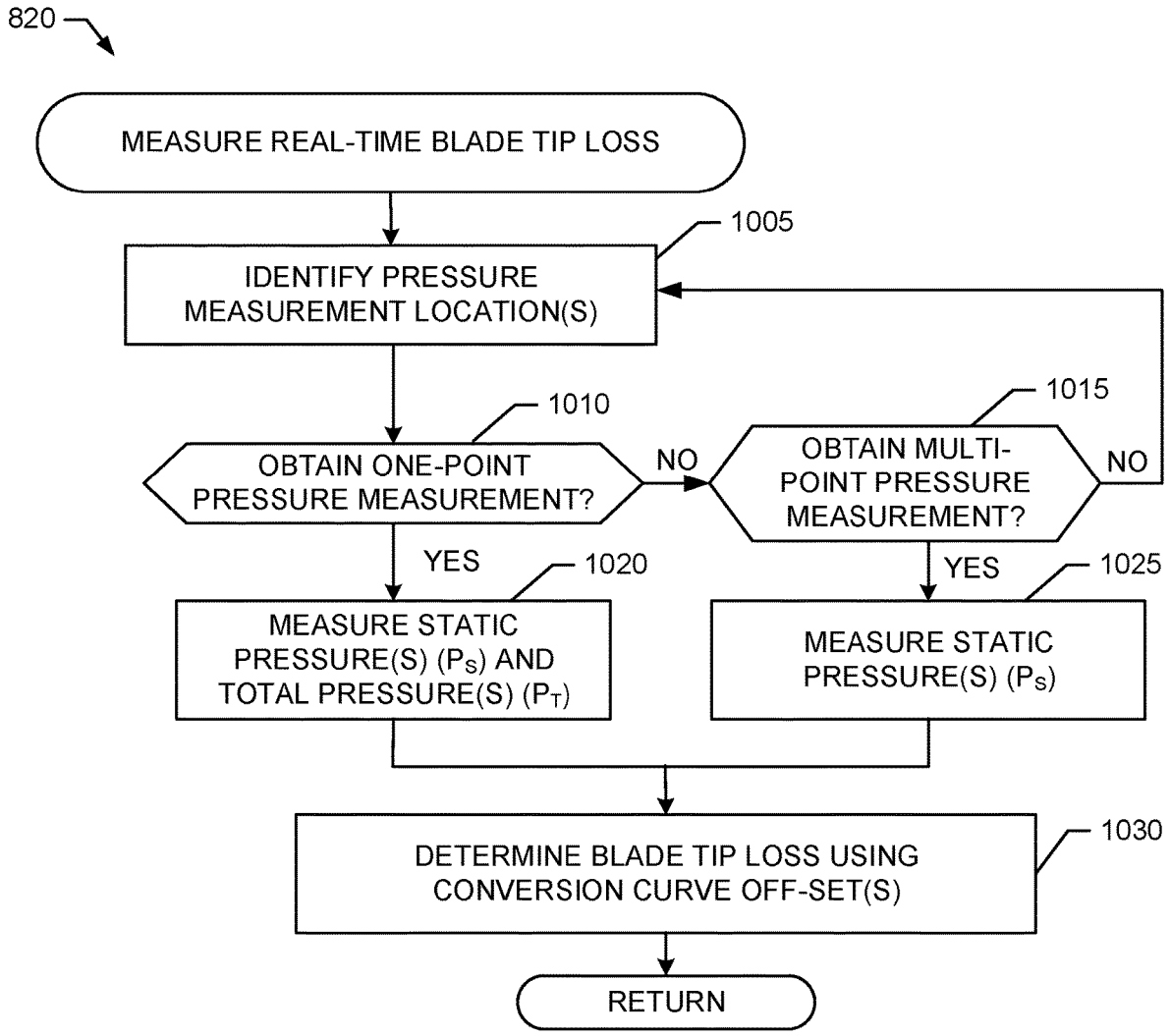
FIG. 10 illustrates a flowchart representative of example machine readable instructions which may be executed to measure real-time blade tip loss using the example blade tip loss determiner of FIG. 7.

Flowcharts representative of example hardware logic, machine readable instructions, hardware implemented state machines, and/or any combination thereof for implementing the blade tip loss determiner 710 of FIG. 7 are shown in FIGS. 8-10. The machine readable instructions may be one or more executable programs or portion(s) of an executable program for execution by a computer processor such as the processor 1112 shown in the example processor platform 1100 discussed below in connection with FIG. 11. The program may be embodied in software stored on a non-transitory computer readable storage medium such as a CD-ROM, a floppy disk, a hard drive, a DVD, a Blu-ray disk, or a memory associated with the processor 1112, but the entire program and/or parts thereof could alternatively be executed by a device other than the processor 1112 and/or embodied in firmware or dedicated hardware. Further, although the example program is described with reference to the flowchart illustrated in FIGS. 8-10, many other methods of implementing the example blade tip loss determiner 710 may alternatively be used. For example, the order of execution of the blocks may be changed, and/or some of the blocks described may be changed, eliminated, or combined. Additionally or alternatively, any or all of the blocks may be implemented by one or more hardware circuits (e.g., discrete and/or integrated analog and/or digital circuitry, an FPGA, an ASIC, a comparator, an operational-amplifier (op-amp), a logic circuit, etc.) structured to perform the corresponding operation without executing software or firmware.

The machine readable instructions described herein may be stored in one or more of a compressed format, an encrypted format, a fragmented format, a compiled format, an executable format, a packaged format, etc. Machine readable instructions as described herein may be stored as data (e.g., portions of instructions, code, representations of code, etc.) that may be utilized to create, manufacture, and/or produce machine executable instructions. For example, the machine readable instructions may be fragmented and stored on one or more storage devices and/or computing devices (e.g., servers). The machine readable instructions may require one or more of installation, modification, adaptation, updating, combining, supplementing, configuring, decryption, decompression, unpacking, distribution, reassignment, compilation, etc. in order to make them directly readable, interpretable, and/or executable by a computing device and/or other machine. For example, the machine readable instructions may be stored in multiple parts, which are individually compressed, encrypted, and stored on separate computing devices, wherein the parts when decrypted, decompressed, and combined form a set of executable instructions that implement a program such as that described herein.

In another example, the machine readable instructions may be stored in a state in which they may be read by a computer, but require addition of a library (e.g., a dynamic link library (DLL)), a software development kit (SDK), an application programming interface (API), etc. in order to execute the instructions on a particular computing device or other device. In another example, the machine readable instructions may need to be configured (e.g., settings stored, data input, network addresses recorded, etc.) before the machine readable instructions and/or the corresponding program(s) can be executed in whole or in part. Thus, the disclosed machine readable instructions and/or corresponding program(s) are intended to encompass such machine readable instructions and/or program(s) regardless of the particular format or state of the machine readable instructions and/or program(s) when stored or otherwise at rest or in transit.

The machine readable instructions described herein can be represented by any past, present, or future instruction language, scripting language, programming language, etc. For example, the machine readable instructions may be represented using any of the following languages: C, C++, Java, C#, Perl, Python, JavaScript, HyperText Markup Language (HTML), Structured Query Language (SQL), Swift, etc.

As mentioned above, the example processes of FIGS. 8-10 can be implemented using executable instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media.

FIG. 8 illustrates a flowchart representative of example machine readable instructions 800 which can be executed to implement the example blade tip loss determiner 710 of FIG. 7. In the example of FIG. 8, the reference point selector 720 identifies reference point(s) to be used for obtaining pressure measurements using one or more pressure sensor(s) 725 (block 805). In some examples, the reference point(s) are determined based on whether the intended pressure measurement will be obtained using a one-point, a two-point, or a three-point pressure measurement. For example, the determination of the reference point(s) can depend on whether a conversion curve is being generated and/or whether the data is being collected during subsequent flight cycles. As such, the reference point(s) can be determined based on positioning and/or availability of the pressure sensor(s) 725. In some examples, the pressure sensor(s) 725 measure static pressure ($P_S$) at an inlet and/or an outlet for the identified reference point(s) for a multi-point pressure measurement (e.g., as described in connection with FIGS. 3-4). In some examples, the pressure sensor(s) 725 measure a total (reference) pressure and a static (local) pressure for a one-point pressure measurement (e.g., as described in connection with FIG. 2) (block 810). Once pressure measurements have been obtained, the conversion curve generator 730 generates conversion curves for the engine(s) being tested (e.g., during ground-based testing and/or in-flight testing) (block 815). For example, the conversion curve generator 730 determines the normalized equation for pressure efficiency (Pη) to generate a linear relationship between the measured pressure efficiency and corresponding clearance. As described in connection with FIGS. 6A-6C, conversion curve development can involve the measurement of clearance 606 at a given active clearance control percentage 604 (e.g., as illustrated in FIG. 6A) as well as the measurement of pressure efficiency 614 at the same active clearance control percentage 604 (e.g., as illustrated in FIG. 6B). The conversion curve generator 730 generates the conversion curve based on these measurements, thereby obtaining a linear relationship between the pressure efficiency 614 and the clearance 606 (e.g., as illustrated in FIG. 6C).

Once conversion curves have been generated (e.g., for different engine power levels, altitudes, etc.), the blade tip loss determiner 710 measures real-time blade tip loss during actual engine flight cycles (block 820), as described in more detail in connection with FIG. 10. The blade tip loss determiner 710 identifies any measurable blade tip loss using the test results analyzer 735 (block 825). For example, the test results analyzer 735 compares obtained pressure measurement data to the generated conversion curve(s), such that any offset from the curve is indicative of engine-based degeneration (e.g., blade tip loss due to oxidation, thermal burn, etc.). If the blade tip loss determiner 710 does not identify any blade tip loss based on the measurement data and/or the test results analyzer 735 output, the blade tip loss determiner 710 continues to monitor for, and/or measure, any real-time blade tip loss (block 820). If the blade tip loss determiner 710 identifies blade tip loss, this data is provided to the controller 705 (block 830). For example, the controller 705 uses the input received from the blade tip loss determiner 710 to adjust and/or optimize the tip clearance (block 835). In some examples, the controller 705 can adjust cooling airflow, resulting in contraction and/or expansion of the casing 142, 157 to achieve a tighter clearance and/or avoid any risk of rubbing between the blade 140, 164, 168 and the casing 142, 157.

FIG. 9 illustrates a flowchart representative of example machine readable instructions 815 which may be executed to generate conversion curve(s) for various power levels and/or altitudes using the example blade tip loss determiner 710 of FIG. 7. In the example of FIG. 9, the reference point selector 720 can identify one or more reference points where pressure measurements can be taken. For example, the reference point selector 720 can identify a forward (e.g., upstream) and/or an aft (e.g., downstream) reference point to use for obtaining one or more pressure measurements (e.g., P1 and/or P2 of FIGS. 3A-3B). Pressure sensor(s) 725 mounted on the engine obtain the forward and/or aft pressure measurement data (block 905). The conversion curve generator 730 receives the sensor-based input data and determines a correlation between the normalized pressure efficiency (Pη) and blade clearance (block 910). For example, the conversion curve generator 730 can determine the normalized pressure efficiency (Pη) based on the input data provided via the pressure sensor(s) 725. In some examples, the conversion curve generator 730 can generate such conversion curves for a range of test flights, not only for a new engine, but also an engine at various flight cycles (block 915). This allows the conversion curves to be validated and permits observation and/or testing of engines with gradual blade loss to investigate the effects of blade length changes on pressure efficiency measurements. In some examples, the testing can be performed at varying power levels (e.g., low power, high power, etc.), as well as a range of altitudes (block 920). Thorough testing and conversion curve development permits the usage of the blade loss determiner 710 during actual in-flight monitoring of clearances and contributes to a more accurate adjustment of the clearances by the active clearance controller 705.

FIG. 10 illustrates a flowchart representative of example machine readable instructions 820 which may be executed to measure real-time blade tip loss using the example blade tip loss determiner 710 of FIG. 7. Once conversion curves have been developed as described in association with FIGS. 8-9, real-time blade tip loss can be assessed in-flight using the blade tip loss determiner 710. For example, the reference point selector 720 identifies pressure measurement locations based on pressure sensor positioning and/or programmed instructions (block 1005). As previously described, the pressure measurements can be obtained using a one-point, two-point, and/or a three-point measurement, depending on factors such as testing site location, the type of sensor(s) being used, etc. The pressure sensor(s) 725 measure static pressure(s) ($P_S$) and/or total pressure(s) ($P_T$) at the identified measurement locations, depending on whether the measurement is a one-point pressure measurement (e.g., including a total pressure measurement) or a multi-point pressure measurement (e.g., including local static pressure measurements). For example, the blade tip loss determiner 710 identifies whether to perform a one-point pressure measurement (block 1010) or a multi-point pressure measurement (block 1015). For example, pressure sensor(s) 725 capable of measuring a total pressure can be used as part of a one-point pressure measurement. As such, the pressure sensor(s) 725 can be used to measure a total pressure and a static pressure (block 1020). In some examples, if the pressure sensor(s) 725 are configured and/or capable of measuring static pressure but not total pressure, the pressure sensor(s) 725 proceed to measure the local static pressure(s) to be used for a multi-point pressure measurement, in accordance with Equations 1-2 (block 1025). In some examples, the measurements can be repeated and/or obtained at set time intervals, depending on controller 705 requirements. For example, measurements can be taken more frequently and/or less frequently depending on flight conditions (e.g., take-off, landing, cruising, etc.) or the measurements can be obtained continuously over the entire duration of the flight. The blade tip loss determiner 710 determines blade tip loss based on conversion curve off-sets identified using the test results analyzer (block 1030). For example, the test results analyzer 735 compares the pressure efficiency data obtained during testing that was used to generate the conversion curves for a new engine to the pressure efficiency measurements obtained during real-time, in-flight data collection. Deviation from the expected pressure measurements can indicate blade tip loss, thereby resulting in pressure variations and larger clearance gaps than actually intended by the controller 705 in the absence of real-time pressure measurement data. As such, the controller 705 determines a corrected clearance based on the real-time pressure measurements, thereby accounting for any clearance variations that are introduced due to gradual blade tip loss.

Figure 11:
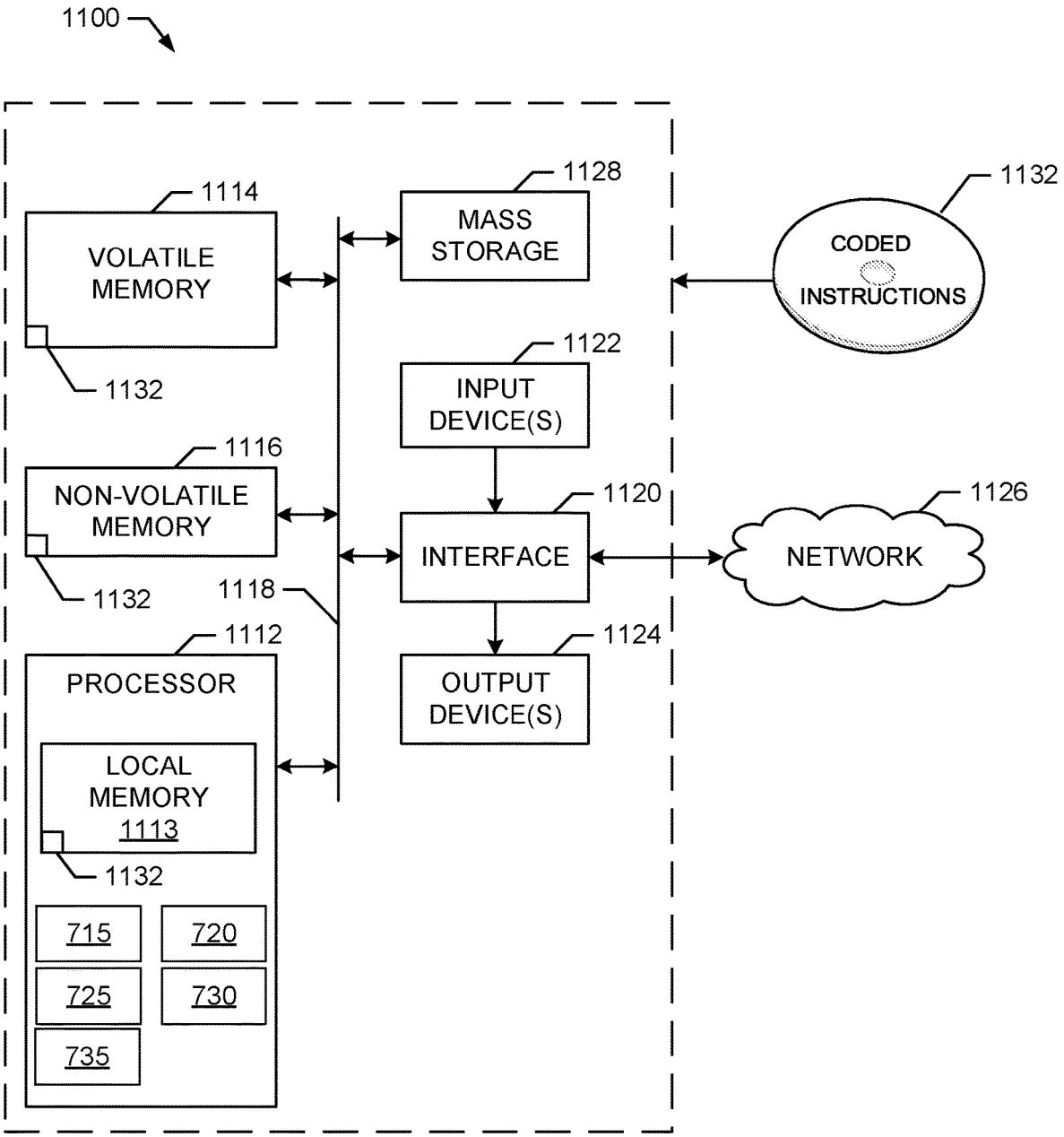
FIG. 11 is a block diagram of an example processing platform structured to execute the instructions of FIGS. 8-10 to implement the example blade tip loss determiner of FIG. 7.

FIG. 11 is a block diagram of an example processing platform structured to execute the instructions of FIGS. 8-10 to implement the example blade tip loss determiner of FIG. 7. The processor platform 1100 can be a server, a personal computer, a workstation, a self-learning machine (e.g., a neural network), or any other type of computing device.

The processor platform 1100 of the illustrated example includes a processor 1112. The processor 1112 of the illustrated example is hardware. For example, the processor 1112 can be implemented by one or more integrated circuits, logic circuits, microprocessors, GPUs, DSPs, or controllers from any desired family or manufacturer. The hardware processor may be a semiconductor based (e.g., silicon based) device. In this example, the processor 1112 implements the example blade tip loss determiner 710 including the example measurement initiator 715, the example reference point selector 720, the example pressure sensor 725, the example conversion curve generator 730, and/or the example test results analyzer 735.

The processor 1112 of the illustrated example includes a local memory 1113 (e.g., a cache). The processor 1112 of the illustrated example is in communication with a main memory including a volatile memory 1114 and a non-volatile memory 1116 via a bus 1118. The volatile memory 1114 may be implemented by Synchronous Dynamic Random Access Memory (SDRAM), Dynamic Random Access Memory (DRAM), RAMBUS® Dynamic Random Access Memory (RDRAM®) and/or any other type of random access memory device. The non-volatile memory 1116 may be implemented by flash memory and/or any other desired type of memory device. Access to the main memory 1114, 1116 is controlled by a memory controller.

The processor platform 1100 of the illustrated example also includes an interface circuit 1120. The interface circuit 1120 may be implemented by any type of interface standard, such as an Ethernet interface, a universal serial bus (USB), a Bluetooth® interface, a near field communication (NFC) interface, and/or a PCI express interface.

In the illustrated example, one or more input devices 1122 are connected to the interface circuit 1120. The input device(s) 1122 permit(s) a user to enter data and/or commands into the processor 1112. The input device(s) 1122 can be implemented by, for example, an audio sensor, a microphone, a camera (still or video), a keyboard, a button, a mouse, a touchscreen, a track-pad, a trackball, isopoint and/or a voice recognition system.

One or more output devices 1124 are also connected to the interface circuit 1120 of the illustrated example. The output devices 1124 can be implemented, for example, by display devices (e.g., a light emitting diode (LED), an organic light emitting diode (OLED), a liquid crystal display (LCD), a cathode ray tube display (CRT), an in-place switching (IPS) display, a touchscreen, etc.), a tactile output device, a printer and/or speaker. The interface circuit 1120 of the illustrated example, thus, typically includes a graphics driver card, a graphics driver chip and/or a graphics driver processor.

The interface circuit 1120 of the illustrated example also includes a communication device such as a transmitter, a receiver, a transceiver, a modem, a residential gateway, a wireless access point, and/or a network interface to facilitate exchange of data with external machines (e.g., computing devices of any kind) via a network 1126. The communication can be via, for example, an Ethernet connection, a digital subscriber line (DSL) connection, a telephone line connection, a coaxial cable system, a satellite system, a line-of-site wireless system, a cellular telephone system, etc.

The processor platform 1100 of the illustrated example also includes one or more mass storage devices 1128 for storing software and/or data. Examples of such mass storage devices 1128 include floppy disk drives, hard drive disks, compact disk drives, Blu-ray disk drives, redundant array of independent disks (RAID) systems, and digital versatile disk (DVD) drives.

The machine executable instructions 1132 of FIGS. 8-10 may be stored in the mass storage device 1128, in the volatile memory 1114, in the non-volatile memory 1116, and/or on a removable non-transitory computer readable storage medium such as a CD or DVD. One or more of the volatile memory 1114, in the non-volatile memory 1116, the mass storage devices 1128, etc., can also be used to implement the example data storage 740, for example.

From the foregoing, it will be appreciated that the disclosed methods and apparatus permit real-time measurement of blade tip clearance that accounts for blade tip loss. An increase in tip clearance contributes to a decrease in turbine efficiency, given that the power that a turbine provides (or a compressor consumes) depends on airflow occurring through the area of the blade location. As such, presence of the tip clearance results in altered airflow, compromising the intended flow path and affecting turbine efficiency, including a potential increase in fuel consumption. Methods and apparatus disclosed herein permit the development of conversion curves that can be used to determine blade tip loss based on identified off-sets from the conversion curves. As such, active clearance control can be used to calculate and adjust clearances with greater accuracy based on real-time data input by accounting for blade tip loss, which would otherwise result in larger clearances and reduced engine efficiency, leading to a shorter engine life span and time on wing. While the examples disclosed herein describe real-time clearance assessment in an example aircraft engine, the methods and apparatus disclosed herein can be used in any turbine engine system. Furthermore, while the examples disclosed herein describe real-time clearance assessment based on low pressure turbine rotor blades and/or high pressure turbine rotor blades, clearance modulation using the methods and apparatus disclosed herein can be applied to any other blades used in an aircraft engine and/or any turbine engine system.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

The following claims are hereby incorporated into this Detailed Description by this reference, with each claim standing on its own as a separate embodiment of the present disclosure.

Further aspects of the invention are provided by the subject matter of the following clauses:

A method to assess real-time blade tip clearance in a turbine engine, the method including determining a first and a second static pressure measurement at a first measurement location and a second measurement location, respectively, relative to the blade tip clearance, determining a normalized pressure measurement using the first and second static pressure measurements, generating a conversion curve to correlate the normalized pressure measurement with a clearance measurement, and adjusting active clearance control of the blade tip clearance based on a comparison of real-time in-flight pressure measurements to the conversion curve.

The method of any preceding clause wherein the first pressure measurement or the second pressure measurement is obtained using a static pressure sensor.

The method of any preceding clause wherein the first or the second static pressure measurement is obtained at an aft location, a middle location, or a forward location relative to a blade and a casing.

The method of any preceding clause wherein the conversion curve is developed for the turbine engine during testing at a plurality of altitudes.

The method of any preceding clause, wherein the conversion curve is developed for the turbine engine during testing at a plurality of power levels, the plurality of power levels including at least one of a low power or a high power.

The method of any preceding clause, wherein the conversion curve is determined based on the clearance measurement and the normalized pressure measurement obtained at varying percentages of active clearance control, the clearance measurement and the normalized pressure measurement correlated based on a percentage of active clearance control corresponding to both measurements.

The method of any preceding clause, wherein the blade tip clearance is based on a distance between a blade and a casing, the blade including a fan blade, a high pressure rotor blade, or a low pressure rotor blade.

The method of any preceding clause, wherein the casing is a fan casing or a turbine casing.

An apparatus to assess real-time blade tip clearance in a turbine engine, the apparatus including a pressure sensor to determine a first and a second static pressure measurement at a first measurement location and a second measurement location, respectively, relative to the blade tip clearance, a conversion curve generator to determine a normalized pressure measurement using the first and second static pressure measurements and generate a conversion curve to correlate the normalized pressure measurement with a clearance measurement, and an active clearance controller to adjust active clearance control of the blade tip clearance based on a comparison of real-time in-flight pressure measurements to the conversion curve.

The apparatus of any preceding clause, further including a reference point selector to obtain the first or second pressure measurement at an aft location, a middle location, or a forward location relative to a blade and a casing.

The apparatus of any preceding clause, wherein the conversion curve generator is to generate the conversion curve for a plurality of altitudes.

The apparatus of any preceding clause, wherein the conversion curve generator is to generate the conversion curve for a plurality of power levels, the plurality of power levels including at least one of a low power or a high power.

The apparatus of any preceding clause, wherein the conversion curve generator is to determine the conversion curve based on the clearance measurement and the normalized pressure measurement obtained at varying percentages of active clearance control, the clearance measurement and the normalized pressure measurement correlated based on a percentage of active clearance control corresponding to both measurements.

The apparatus of any preceding clause, further including a test results analyzer to compare in-flight pressure measurement data to the conversion curve generated for a new engine.

A non-transitory computer readable medium including machine-readable instructions that, when executed, cause a processor to at least determine a first and a second static pressure measurement at a first measurement location and a second measurement location, respectively, relative to the blade tip clearance based on signals received as input to the processor, determine a normalized pressure measurement using the first and second static pressure measurements, generate a conversion curve to correlate the normalized pressure measurement with a clearance measurement, and adjust active clearance control of the blade tip clearance based on a comparison of real-time in-flight pressure measurements to the conversion curve.

The non-transitory computer readable medium of any preceding clause, wherein the location of the static pressure measurement is in at least one of an aft, a middle, or a forward location relative to a blade and a casing.

The non-transitory computer readable medium of any preceding clause, wherein the instructions are to cause the processor to develop the conversion curve for a turbine engine at a plurality of altitudes.

The non-transitory computer readable medium of any preceding clause, wherein the instructions are to cause the processor to develop the conversion curve for a turbine engine at a plurality of power levels, the plurality of power levels including at least one of a low power or a high power.

The non-transitory computer readable medium of any preceding clause, wherein the instructions are to cause the processor to develop the conversion curve based on the clearance measurement and the normalized pressure measurement obtained at varying percentages of active clearance control, the clearance measurement and the normalized pressure measurement correlated based on a percentage of active clearance control corresponding to both measurements.

The non-transitory computer readable medium of any preceding clause, wherein the instructions are to cause the processor to adjust the blade tip clearance based on a distance between a blade and a casing, the blade including a fan blade, a high pressure rotor blade, or a low pressure rotor blade.

What is claimed is:

1. A method to assess real-time blade tip clearance in a turbine engine, the method comprising:

determining a first and a second static pressure measurement at a first measurement location and a second measurement location, respectively, relative to the blade tip clearance;

determining a normalized pressure measurement using the first and second static pressure measurements;

generating a conversion curve to correlate the normalized pressure measurement with a clearance measurement, wherein the conversion curve is developed for the turbine engine during testing at a plurality of operating conditions; and adjusting active clearance control of the blade tip clearance based on the conversion curve.

2. The method of claim 1, wherein the first static pressure measurement or the second static pressure measurement is obtained using a static pressure sensor.

3. The method of claim 1, wherein the first or the second static pressure measurement is obtained at an aft location, a middle location, or a forward location relative to a blade and a casing.

4. The method of claim 1, wherein the conversion curve is developed for the turbine engine during testing at a plurality of power levels, the plurality of power levels including at least one of a low power or a high power.

5. The method of claim 1, wherein the conversion curve is determined based on the clearance measurement and the normalized pressure measurement obtained at varying percentages of active clearance control, the clearance measurement and the normalized pressure measurement correlated based on a percentage of active clearance control corresponding to both measurements.

6. The method of claim 1, wherein the blade tip clearance is based on a distance between a blade and a casing, the blade including a fan blade, a high pressure rotor blade, or a low pressure rotor blade.

7. The method of claim 6, wherein the casing is a fan casing or a turbine casing.

8. The method of claim 1, wherein the plurality of operating conditions include a plurality of altitudes.

9. An apparatus to assess real-time blade tip clearance in a turbine engine, the apparatus comprising:

a pressure sensor to determine a first and a second static pressure measurement at a first measurement location and a second measurement location, respectively, relative to the blade tip clearance;

a conversion curve generator to:

determine a normalized pressure measurement using the first and second static pressure measurements; and generate a conversion curve to correlate the normalized pressure measurement with a clearance measurement, wherein the conversion curve is developed for the turbine engine during testing at a plurality of operating conditions; and an active clearance controller to adjust active clearance control of the blade tip clearance based on the conversion curve.

10. The apparatus of claim 9, further including a reference point selector to obtain the first or second static pressure measurement at an aft location, a middle location, or a forward location relative to a blade and a casing.

11. The apparatus of claim 9, wherein the conversion curve generator is to generate the conversion curve for a plurality of power levels, the plurality of power levels including at least one of a low power or a high power.

12. The apparatus of claim 9, wherein the conversion curve generator is to determine the conversion curve based on the clearance measurement and the normalized pressure measurement obtained at varying percentages of active clearance control, the clearance measurement and the normalized pressure measurement correlated based on a percentage of active clearance control corresponding to both measurements.

13. The apparatus of claim 9, further including a test results analyzer to compare in-flight pressure measurement data to the conversion curve generated for a new engine.

14. The apparatus of claim 9, wherein the plurality of operating conditions include a plurality of altitudes.

15. A non-transitory computer readable medium comprising machine-readable instructions that, when executed, cause a processor to at least:

determine a first and a second static pressure measurement at a first measurement location and a second measurement location, respectively, relative to a blade tip clearance based on signals received as input to the processor;

determine a normalized pressure measurement using the first and second static pressure measurements;

generate a conversion curve to correlate the normalized pressure measurement with a clearance measurement, the conversion curve developed for a turbine engine during testing at a plurality of operating conditions; and adjust active clearance control of the blade tip clearance based on the conversion curve.

16. The non-transitory computer readable medium of claim 15, wherein the location of the first or the second static pressure measurement is in at least one of an aft, a middle, or a forward location relative to a blade and a casing.

17. The non-transitory computer readable medium of claim 15, wherein the instructions are to cause the processor to develop the conversion curve for a turbine engine at a plurality of power levels, the plurality of power levels including at least one of a low power or a high power.

18. The non-transitory computer readable medium of claim 15, wherein the instructions are to cause the processor to develop the conversion curve based on the clearance measurement and the normalized pressure measurement obtained at varying percentages of active clearance control, the clearance measurement and the normalized pressure measurement correlated based on a percentage of active clearance control corresponding to both measurements.

19. The non-transitory computer readable medium of claim 15, wherein the instructions are to cause the processor to compare in-flight pressure measurement data to the conversion curve generated for a new engine.

20. The non-transitory computer readable medium of claim 15, wherein the plurality of operating conditions include a plurality of altitudes.

* * * * *